US007793847B2

(12) United States Patent
Kakinuma et al.

(10) Patent No.: US 7,793,847 B2
(45) Date of Patent: Sep. 14, 2010

(54) COIN-SHAPED RECORDING MEDIUM, RECORDING MEDIUM PROCESSING DEVICE

(75) Inventors: Takeshi Kakinuma, Kaizu (JP); Takahiro Ono, Ichinomiya (JP); Ikutaroh Nagatsuka, Ebina (JP); Tsutomu Ishii, Ebina (JP); Shigeru Yamamoto, Ebina (JP)

(73) Assignees: OMRON Corporation, Kyoto (JP); Fuji Xerox Co., Ltd., Tokyo (JP)

( * ) Notice: Subject to any disclaimer, the term of this patent is extended or adjusted under 35 U.S.C. 154(b) by 1450 days.

(21) Appl. No.: 11/150,846

(22) Filed: Jun. 10, 2005

(65) Prior Publication Data

US 2006/0003842 A1 Jan. 5, 2006

(30) Foreign Application Priority Data

Jun. 11, 2004 (JP) ..... 2004-174647

(51) Int. Cl.
*G06K 19/06* (2006.01)

(52) U.S. Cl. ..... 235/492

(58) Field of Classification Search ..... 235/492
See application file for complete search history.

(56) References Cited

U.S. PATENT DOCUMENTS

| | | | | |
|---|---|---|---|---|
| 6,276,608 | B1 * | 8/2001 | Cockayne et al. | 235/492 |
| 6,293,470 | B1 * | 9/2001 | Asplund | 235/487 |
| 6,330,977 | B1 * | 12/2001 | Hass et al. | 235/487 |
| 6,621,153 | B2 | 9/2003 | Kawai et al. | |
| 6,629,591 | B1 * | 10/2003 | Griswold et al. | 194/205 |
| 2002/0005845 | A1 | 1/2002 | Kondo et al. | |
| 2003/0011868 | A1 * | 1/2003 | Zehner et al. | 359/296 |

FOREIGN PATENT DOCUMENTS

| | | | |
|---|---|---|---|
| JP | 2000-111942 | | 4/2000 |
| JP | 2000111942 | A * | 4/2000 |
| JP | 2001-62123 | | 3/2001 |
| JP | 2001-300114 | | 10/2001 |
| JP | 2002-7989 | | 1/2002 |
| JP | 2002-015291 | A | 1/2002 |
| JP | 2002-239080 | A | 8/2002 |
| JP | 2002-312745 | | 10/2002 |

OTHER PUBLICATIONS

Patent Abstracts of Japan, Publication No. 2002-312745, Publication Date Oct. 25, 2002, 1 page.

(Continued)

*Primary Examiner*—Daniel A Hess
*Assistant Examiner*—David Tardif
(74) *Attorney, Agent, or Firm*—Osha • Liang LLP

(57) ABSTRACT

An IC coin includes an antenna coil for transmitting and receiving value information to and from a recording medium processing device, an RF-ID tag for recording the value information, an image display medium to or from which an image is written or deleted by applying voltage, an anode terminal exposed on an external surface of the IC coin to input voltage applied to the image display medium by connecting with an external terminal, and cathode terminals. In the IC coin having this structure, voltage for writing or deleting an image can be inputted from outside and an image can be written or deleted to or from the IC coin.

11 Claims, 21 Drawing Sheets

OTHER PUBLICATIONS

Partial English Translation of Japanese Unexamined Patent Publication No. 2002-312745, 4 pages.

Patent Abstracts of Japan, Publication No. 2001-300114, Publication Date Oct. 30, 2001, 1 page.

Partial English Translation of Japanese Unexamined Patent Publication No. 2001, 300114, 5 pages.

Patent Abstracts of Japan, Publication No. 2001-062123, Publication Date Mar. 13, 2001, 1 page.

Partial English Translation of Japanese Unexamined Patent Publication No. 2001-62123, 2 pages.

Patent Abstracts of Japan, Publication No. 2000-111942, Publication Date Apr. 21, 2000, 1 page.

Partial English Translation of Japanese Unexamined Patent Publication No. 2000-111942, 4 pages.

Patent Abstracts of Japan, Publication No. 2002-007989, Publication Date Jan. 11, 2002, 1 page.

Notification of Reasons for Refusal issued in Japanese Application No. 2004-174647 mailed Nov. 17, 2009 and English translation thereof, 6 pages.

* cited by examiner

COIN-SHAPED RECORDING MEDIUM, RECORDING MEDIUM PROCESSING DEVICE

This Nonprovisional application claims priority under 35 U.S.C. §119(a) on Patent Application No. 2004-174647 filed in Japan on Jun. 11, 2004, the entire contents of which are hereby incorporated by reference.

BACKGROUND OF THE INVENTION

1. Field of the Invention

The present invention relates to a coin-shaped recording medium on which value data can be recorded and rewritten, and to a recording medium processing device for transmitting and receiving information to and from the coin-shaped recording medium.

2. Background Art

Currently, a coin-shaped recording medium such as an IC card for recording information has been used for a play machine such as a pinball machine (pachinko) and a slot machine. The play machine includes an information processing device for reading and writing value data, which shows a value degree obtained by converting information possessed by a user (monetary data and data showing the numbers of pinballs and medals), from and to the recording medium. For example, see JP-A-2002-312745 (publication date: Oct. 25, 2002), JP-A-2002-7989 (publication date: Jan. 11, 2002), and JP-A-2001-300114 (publication date: Oct. 30, 2001).

More specifically, a user inserts a recording medium into an information processing device provided on a play machine at the beginning of play. Then, the information processing device reads the value data from the inserted recording medium and displays the value data on a display panel or the like. The user is thus notified about the number of pinballs or medals usable for play.

After the end of the play, the information processing device converts the number of remaining pinballs, medals or the like and writes to the recording medium as value data, and returns the recording medium to the user. Thus, the user can start the play machine by inserting the recording medium thereto instead of inserting the pinballs, medals or the like.

In the recording medium used for the above-described play machine, while the value data showing the degree of the remaining value after play is written to the recording medium returned to the user after play, the value degree is not indicated on the recording medium. Thus, the user after play has to again insert the coin-shaped recording medium into the information processing device or a charge adjusting machine for the coin-shaped recording medium to check his/her value data, which is bothersome for the user.

In order to overcome this problem, a technique has been disclosed in which a coin-shaped recording medium which has a rewritable display unit for displaying an image with heat reversible ink or magnetic powder to display value data recorded on the coin-shaped recording medium to a user (see JP-A-2001-62123, publication date: Mar. 13, 2001). In this technique, the image display on the recording medium can be maintained without requiring power supply, and thus the user can check his or her value data shown on the display unit of the coin-shaped recording medium after play.

In association with this technique, an image display medium on which an image is rewritten by applying voltage only at the time of writing the image and is maintained without power supply has been recently developed (see JP-A-2000-111942, publication date: Apr. 21, 2000). When the image display medium of this type is used as the above coin-shaped recording medium, it is expected that the user can check his or her value data from the image display medium provided on the coin-shaped recording medium after play since the image display is maintained on the recording medium without power supply. However, in cases where the above image display medium is applied to the coin-shaped recording medium, it is impossible to rewrite the displayed value data without inputting voltage required at the time of writing an image from outside to the coin-shaped recording medium.

SUMMARY OF THE INVENTION

Wherefore, it is an object of the invention to provide a coin-shaped recording medium to which voltage for rewriting an image to be applied to an image display element can be inputted from outside and a recording medium processing device for the coin-shaped recording medium.

For achieving the above object, a coin-shaped recording medium according to the invention includes: an image display portion to or from which an image can be written or deleted by applying voltage thereto; and a voltage input portion exposed on an external surface of the coin-shaped recording medium to input voltage applied to the image display portion by connecting with an external terminal.

Thus, voltage for writing or deleting an image can be inputted from outside, and an image can be written or deleted to the coin-shaped recording medium.

Additionally, for achieving the above object, a recording medium processing device according to the invention includes: a locating portion locating the coin-shaped recording medium in a predetermined position; an image writing portion writing an image to the image display portion; and a voltage applying portion applying voltage to the voltage input portion of the coin-shaped recording medium located in the predetermined position by connecting with the voltage input portion.

Thus, the recording medium processing device can apply voltage to the image display portion of the coin-shaped recording medium located in the predetermined position and thereby write an image to the image display portion.

For a fuller understanding of the nature and advantages of the invention, reference should be made to the ensuing detailed description taken in conjunction with the accompanying drawings.

BRIEF DESCRIPTION OF THE DRAWINGS

FIGS. 14A through 14D illustrate images displayed on the IC coin shown in FIG. 13, wherein: FIG. 14A shows monetary information; FIG. 14B shows an image of a shop name; FIG. 14C shows information on an event held in a shop; and FIG. 14D shows a picture, all displayed on the IC coin.

FIGS. 15A and 15B illustrate an IC coin which displays an image on one face in a second embodiment according to the invention, wherein FIG. 15A is a perspective view of the IC coin and FIG. 15B is a perspective view of the disassembled IC coin.

FIGS. 16A and 16B illustrate an IC coin which displays images on both faces in the second embodiment according to the invention, wherein FIG. 16A is a perspective view of the IC coin and FIG. 16B is a perspective view of the disassembled IC coin.

FIGS. 17A and 17B illustrate a recording medium processing device in the second embodiment according to the invention, wherein FIG. 17A shows an external appearance of the recording medium processing device and FIG. 17B is a perspective view of the disassembled recording medium processing device.

FIGS. 20A and 20B illustrate images displayed on the IC coin shown in FIGS. 16A and 16B, wherein FIG. 20A shows monetary information and FIG. 20B shows an image of a shop name, both displayed on the IC coin.

FIGS. 21A and 21B illustrate an IC coin which displays an image on one face in a third embodiment according to the invention, wherein FIG. 21A is a perspective view of the IC coin and FIG. 21B is a perspective view of the disassembled IC coin.

FIGS. 22A and 22B illustrate an IC coin which displays images on both faces in the third embodiment according to the invention, wherein FIG. 22A is a perspective view of the IC coin and FIG. 22B is a perspective view of the disassembled IC coin.

FIGS. 23A and 23B illustrate a recording medium processing device in the third embodiment according to the invention, wherein FIG. 23A shows an external appearance of the recording medium processing device and FIG. 23B is a perspective view of the disassembled recording medium processing device.

FIGS. 26A through 26C illustrate images displayed on the IC coin shown in FIGS. 22A and 22B, wherein: FIG. 26A shows monetary information; FIG. 26B shows an image of a shop name; and FIG. 26C shows information on an event held in a shop, all displayed on the IC coin.

DESCRIPTION OF THE PREFERRED EMBODIMENTS

Embodiment 1

One embodiment according to the invention is hereinafter described with reference to FIGS. 1 through 14.

(System Structure)

Figure 1:
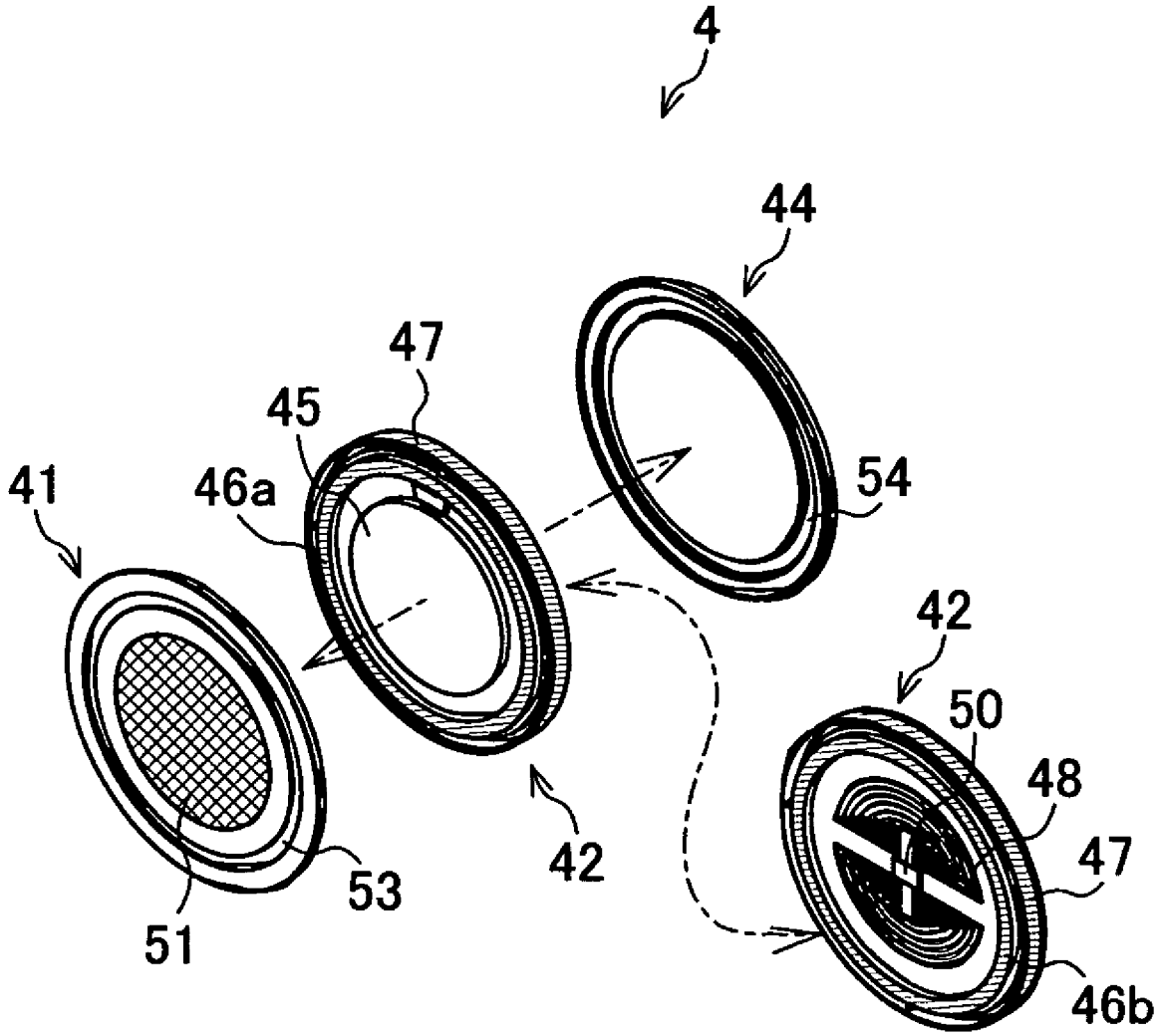
FIG. 1 is a perspective view of a disassembled IC coin which displays an image on one face in a first embodiment according to the invention.
Figure 2:
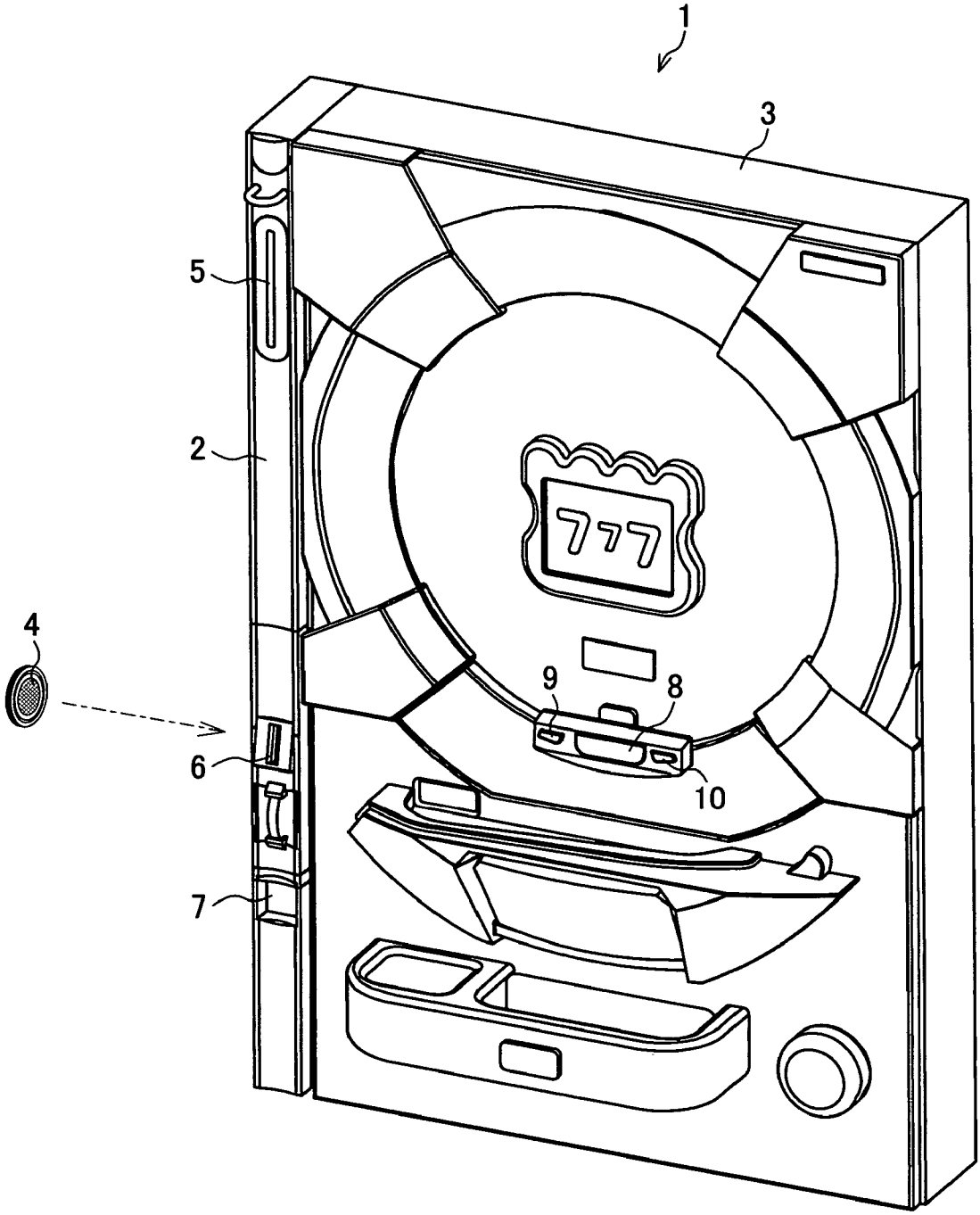
FIG. 2 is a schematic view of a pinball supply machine and a pinball machine in the first embodiment according to the invention.

A play machine system 1 in this embodiment is now described in conjunction with FIG. 2. As illustrated in FIG. 2, the play machine system 1 includes a pinball supply machine 2, and a pinball machine 3 disposed adjacent to the pinball supply machine 2. The play machine system 1 provides pinball play service to a user using an IC coin 4 (see FIG. 1) on which value information (value data) is recorded.

The pinball supply machine 2 has a function for reading and writing information from and to the IC coin (coin-shaped recording medium) 4. The pinball machine 3 performs pinball-play processing in accordance with the value information read from the IC coin 4 by the pinball supply machine 2. The pinball machine 3 is capable of communicating with the pinball supply machine 2 by wire. The value information in this embodiment refers to data showing a value degree of the IC coin 4 in relation to monetary value. However, the value information may be other information such as the number of pinballs usable for play.

Also, while the pinball machine 3 is used as the play machine in this embodiment, any play machines may be employed as long as play is carried out in accordance with the value information. For example, the play machine may be a so-called pinball-slot machine or a game machine found in a game center.

(Pinball Supply)

As illustrated in FIG. 2, a bill inlet 5, an IC coin inlet 6, and an IC coin outlet 7 are provided on the outer surface of the pinball supply machine 2. On the other hand, a pinball supply display unit 8, a pinball supply input unit 9, and a return switch 10 are provided on the outer surface of the pinball machine 3.

The bill inlet 5 is an inlet through which cash in the form of bills is inserted by a user when play is paid for in cash. The bill inlet 5 is also used to return bills to the user.

The IC coin inlet 6 is an opening through which the IC coin 4 is inserted to be supplied to a recording medium processing device (to be described later) disposed inside the pinball supply machine 2 when the user plays the pinball machine 3. The IC coin outlet 7 is an opening through which the IC coin 4 is discharged to be returned to the user when the user ends play of the pinball machine 3. While the IC coin inlet 6 and the IC coin outlet 7 are separately formed in this embodiment, only a single opening may be provided as both inlet and outlet through which the IC coin 4 is inserted and discharged.

The pinball supply display unit 8 is a panel for displaying information on the number of pinballs calculated from the monetary value indicated in the value information recorded on the IC coin 4.

The pinball supply input unit 9 is a unit to which the number of pinballs to be used (the number of pinballs to be supplied) and the like are inputted. When the number of pinballs to be used is inputted to this unit, pinballs in the same number as the inputted number are supplied to the pinball machine 3. Simultaneously, the number of usable pinballs which is displayed on the pinball supply display unit 8 is decreased by the number of pinballs supplied to the pinball machine 3. Also, the value information recorded on the IC coin 4 is updated such that the monetary value is decreased by the number of pinballs supplied to the pinball machine 3.

The return switch 10 is a switch through which a return command is inputted by the user. When the user pushes the return switch 10, the inserted IC coin 4 is returned to the user.

As described above, the pinball supply machine 2 collects a charge using the IC coin 4 and controls the supply of pinballs to the pinball machine 3 based on the collection of the charge. A pinball supply controller (not shown), and a recording medium processing device 20 are provided inside the pinball supply machine 2. The pinball supply controller controls the supply of pinballs based on the collection of the charge using the IC coin 4. The recording medium processing device 20 controls the collection of the charge using the IC coin 4, and various components provided on the pinball supply machine 2 and the pinball machine 3. Hereinafter, the IC coin 4 and the recording medium processing device 20 are described in detail.

(Structure of IC Coin 4)

Figure 3:
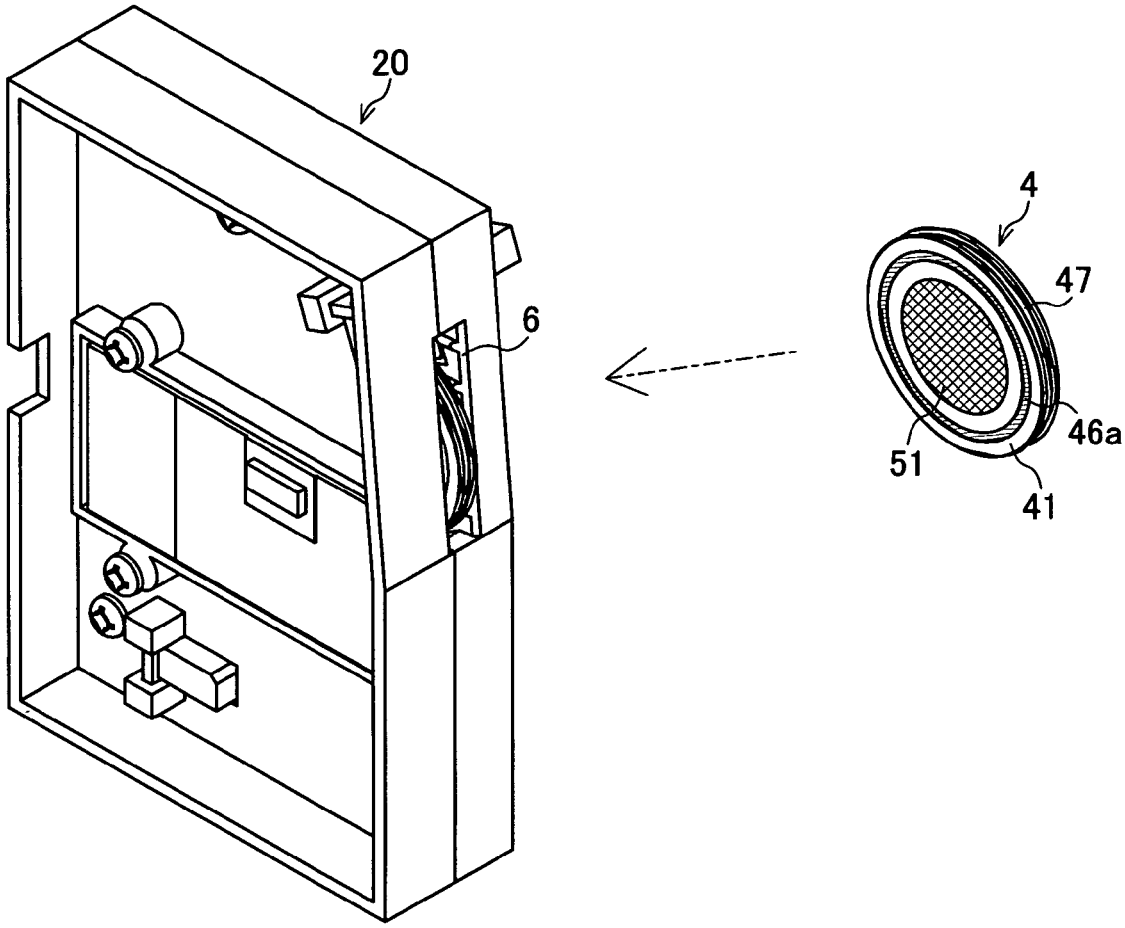
FIG. 3 is a perspective view of the IC coin and a recording medium processing device in the first embodiment according to the invention.

The structure of the IC coin 4 is first described. As illustrated in FIG. 3, the IC coin 4 is a coin-shaped recording medium which is capable of transmitting and receiving value information to and from the recording medium processing device 20 by radio and recording the value information. The IC coin 4 has an image display medium for displaying an image.

The IC coin 4, as the coin-shaped recording medium to record the value information, is needed when the user plays the pinball machine 3. The monetary value indicated in the value information recorded on the IC coin 4 is updated such that the value decreases every time the user receives pinballs. When the value is decreased to zero, the pinball supply machine 2 collects the IC coin 4. When the user desires to continue the play, he or she is required to purchase another IC coin 4.

In this embodiment, the IC coin 4 is collected after the value information is used up. However, the monetary value indicated in the value information of the IC coin 4 may be increased by a charge adjusting machine or the like on condition that the charge will be paid later to repeatedly use the same IC coin 4.

Next, the structure of the IC coin 4 in this embodiment is specifically described. FIG. 1 is a perspective view of the disassembled IC coin 4.

As illustrated in FIG. 1, the IC coin 4 is formed by stacking a front cover 41, a coin main body 42, and a rear cover 44 in this order each of which parts is disk-shaped and has the same radius. In the figure, the coin main body 42 is shown in two ways to show different faces.

A disk-shaped image display medium 45 having a smaller diameter than that of the coin main body 42, and a ring-shaped cathode terminal 46*a* encircling the outer periphery of the image display medium 45 are provided on one face of the coin main body 42. Also, a disk-shaped antenna coil 48 having a smaller diameter than that of the coin main body 42, a ring-shaped cathode terminal 46*b* encircling the outer periphery of the antenna coil 48, and an RF-ID tag 50 mounted on the antenna coil 48 are provided on the other face of the coin main body 42. In addition, an anode terminal 47 is so formed as to encircle the side of the coin main body 42.

An image can be written to or deleted from the image display medium 45 by applying voltage and directing light thereto, and the image can be maintained without power supply after being written. In this embodiment, E-paper (registered trademark) manufactured by Fuji Xerox Co. Ltd. is used as the image display medium 45. The image display medium 45 includes an organic photo-conductive layer and a liquid crystal display layer sandwiched between two base films. The liquid crystal display layer is constituted by cholesteric liquid crystal. In this structure, resistance of the organic photo-conductive layer is varied by directing and not directing light thereto which is emitted from an image writing device (to be described later) such as a light-emission panel, and divided voltage of the liquid crystal display layer to which voltage is applied is controlled by varying the resistance of the organic photo-conductive layer. Therefore, an image can be formed on the liquid crystal display layer and maintained thereon without power supply. While the above-described E-paper is used as the image display medium in this embodiment, other display media may be used as long as an image can be written to those by applying voltage.

The cathode terminals 46*a* and 46*b* and the anode terminal 47 are electrodes made of conductive metal. Those terminals are exposed on the IC coin 4 to input voltage through connection with external terminals, and apply the voltage to the liquid crystal display layer of the image display medium 45. It is possible to prevent corrosion of the cathode terminals 46*a* and 46*b* and the anode terminal 47 which are exposed to the outside by forming these terminals from a stainless alloy.

The antenna coil (transmitting and receiving portion) 48 is a communication antenna for transmitting and receiving value information to and from the recording medium processing device 20 by radio. The RF-ID tag (recording circuit) 50 is an integrated circuit device capable of recording the value information, and updates recording of received value information when the antenna coil 48 receives the value information.

The front cover 41 is a cover for protecting the inside of the IC coin 4, and is constituted by a disk-shaped transparent cover 51 having a smaller diameter than that of the front cover 41, and an electrode window 53 which is open and encircles the outer periphery of the transparent cover 51. It is assumed herein that the face of the IC coin 4 on which the front cover 41 is formed is the front face of the IC coin 4.

The rear cover 44 is a non-transparent resin cover for protecting the inside of the IC coin 4. The rear cover 44 has an electrode window 54 which is open and encircles the inner periphery of the rear cover 44. It is assumed herein that the face of the IC coin 4 on which the rear cover 44 is formed is the back face of the IC coin 4.

The face of the coin main body 42 on which the image display medium 45 and the cathode terminal 46*a* are formed is opposed to the front cover 41. The transparent cover (transparent material) 51 of the front cover 41 is disposed in such a position as to be opposed to the image display medium (first image display medium, image display portion) 45, and the electrode window 53 of the front cover 41 is disposed in such a position as to be opposed to the cathode terminal 46*a*.

The face of the coin main body 42 on which the cathode terminal 46*b* is formed is opposed to the rear cover 44. The electrode window 54 of the rear cover 44 is disposed in such a position as to be opposed to the cathode terminal 46*b*.

When the IC coin 4 is assembled by stacking the front cover 41, the coin main body 42, and the rear cover 44 each having the above structure, the cathode terminal (first type electrode, voltage input portion) 46*a* disposed on the front face of the IC coin 4 (the front cover 41 side) is exposed to the outside through the electrode window 53 as illustrated in FIG. 3. Also, the cathode terminal (first type electrode, voltage input portion) 46*b* disposed on the back face of the IC coin 4 (the rear cover 44 side) is exposed to the outside through the electrode window 54. Further, the anode terminal (second type electrode, voltage input portion) 47 disposed on the side of the IC coin 4 is exposed to the outside.

The image display medium 45 on the front face of the IC coin 4 (the front cover 41 side) can be visually checked from outside through the transparent cover 51. That is, the transparent cover 51 allows the image display medium 45 to be visually checked from outside and functions as a cover for protecting the image display medium 45 from outside. In this embodiment, the transparent cover 51 is made of PET (polyethylene terephthalate). However, the material of the transparent cover 51 is not limited to PET, but may be any materials as long as they are transparent.

(Structure of Recording Medium Processing Device 20)

Next, the structure of the recording medium processing device 20 shown in FIG. 3 is described. The recording medium processing device 20 has a function of transmitting and receiving value information by radio to and from the IC coin 4 which is inserted through the IC coin inlet 6 and located at a HP (home position, predetermined position) within the recording medium processing device 20. The recording medium processing device 20 has another function of controlling various components provided on the pinball supply machine 2 and the pinball machine 3. The recording medium processing device 20 has a further function of writing an image to the image display medium 45 of the IC coin 4.

Figure 4:
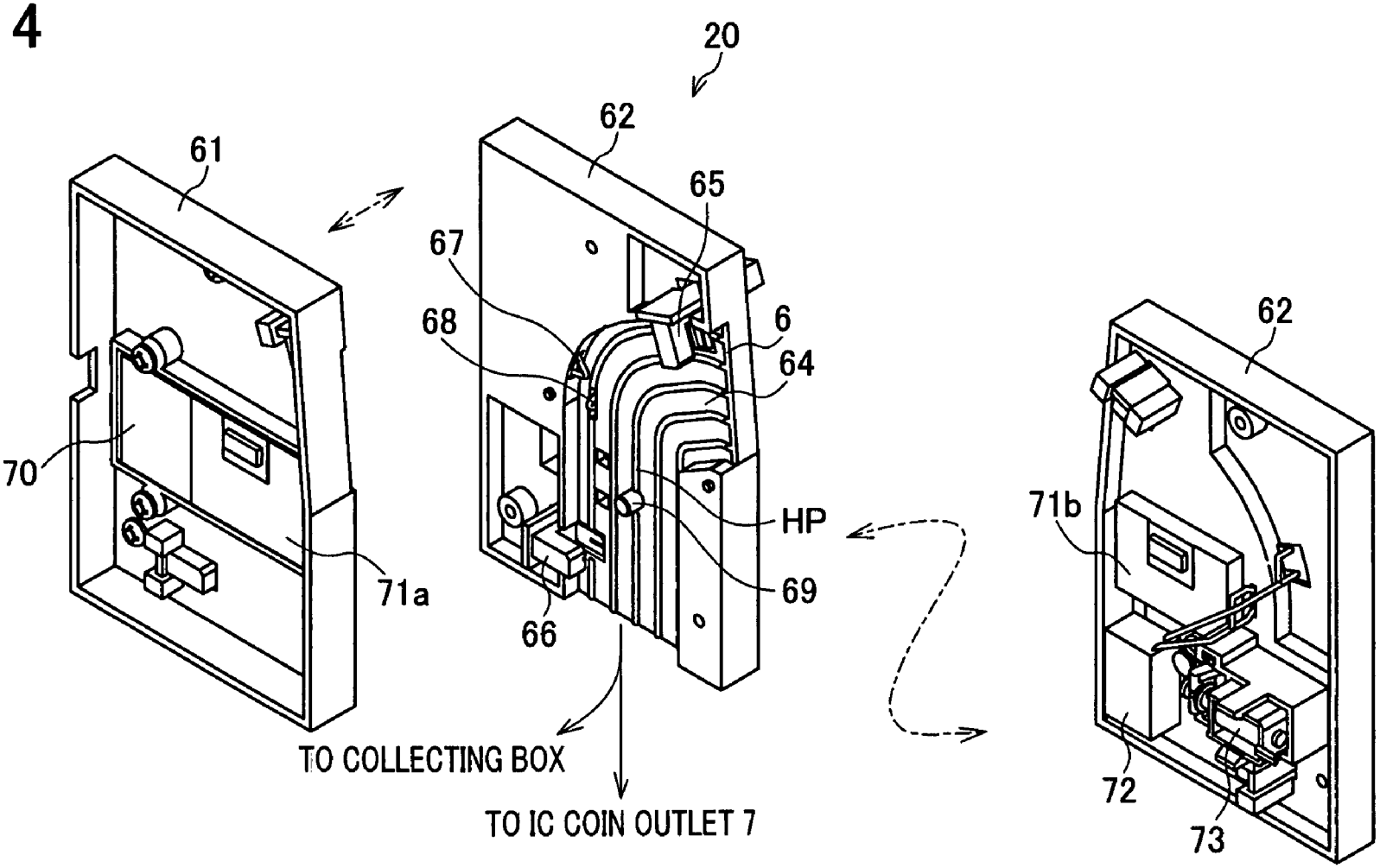
FIG. 4 is a perspective view of the disassembled recording medium processing device shown in FIG. 3.

FIG. 4 is a perspective view of the disassembled recording medium processing device 20 shown in FIG. 3. As illustrated in this figure, the recording medium processing device 20 is formed by joining a housing 61 and a housing 62. In FIG. 4, the housing 62 is shown in two ways to show different faces.

A passage 64, an insertion sensor 65, a return sensor 66, an anode terminal 67, a cathode terminal 68, and a stopper 69 are provided on one face of the housing 62 facing to the housing 61.

The passage (locating portion) 64 is a passage through which the IC coin 4 travels. The IC coin 4 inserted from the IC coin inlet 6 travels through the passages 64 by its own weight, and reaches the HP for the IC coin 4, that is, the position where the IC coin 4 coming through the passage 64 is received.

Figure 5:
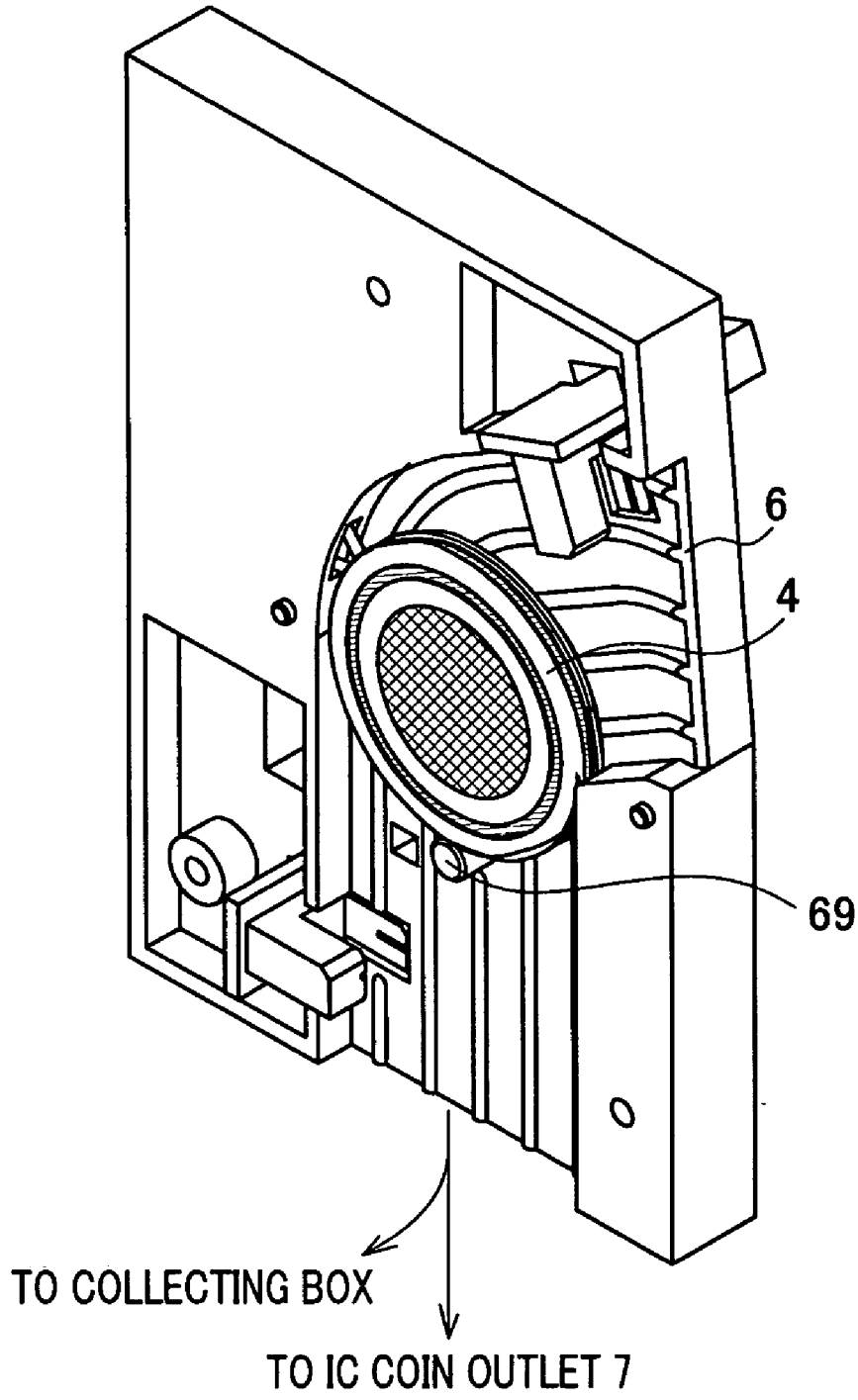
FIG. 5 is a perspective view illustrating an inside structure of the recording medium processing device shown in FIG. 3 in which the IC coin is retained at an HP.

The stopper 69 is disposed in the vicinity of the HP as a pin for retaining at the HP the IC coin 4 inserted from the IC coin inlet 6. In the condition where the stopper 69 projects out as illustrated in FIG. 5, the IC coin 4 inserted from the IC coin inlet 6 is retained at the HP while being supported by the stopper 69. However, in the condition where the stopper 69 is withdrawn, the IC coin 4 goes to the IC coin outlet 7 or a collecting box (not shown).

The insertion sensor 65 is disposed in the vicinity of the IC coin inlet 6 to detect insertion of the IC coin 4 from the IC coin inlet 6.

The return sensor 66 is disposed in the vicinity of the IC coin outlet 7 in the passage 64 to detect return of the IC coin 4.

The anode terminal (voltage applying portion) 67 is an electrode for applying voltage, disposed in such a position as to connect with the anode terminal 47 constituting the side of the IC coin 4 when the IC coin 4 is retained at the HP. The voltage outputted from the anode terminal 67 is applied to the anode terminal 47 of the IC coin 4. Since the anode terminal 47 encircles the side of the IC coin 4, connection between the anode terminal 67 and the anode terminal 47 can be made regardless of the orientation of the IC coin 4 during retention of the IC coin 4 at the HP only by disposing the anode terminal 67 in such a position as to contact any portion of the side of the IC coin 4 retained at the HP.

The cathode terminal (voltage applying portion) 68 is an electrode for applying voltage, disposed in such a position as to connect with the cathode terminal 46*a* or 46*b* of the IC coin 4 when the IC coin 4 is retained at the HP. When the front face of the IC coin 4 retained at the HP faces to the housing 62, the cathode terminal 68 is disposed in such a position as to contact the cathode terminal 46*a* of the IC coin 4 regardless of the orientation of the IC coin 4 during retention of the IC coin 4 at the HP. When the back face of the IC coin 4 retained at the HP faces to the housing 62, the cathode terminal 68 is disposed in such a position as to contact the cathode terminal 46*b* of the IC coin 4 regardless of the orientation of the IC coin 4 during retention of the IC coin 4 at the HP. Since the cathode terminal 46*a* encircles the inner periphery of the front face of the IC coin 4 and the cathode terminal 46*b* encircles the inner periphery of the back face of the IC coin 4, the cathode terminal 68 invariably contacts either the cathode terminal 46*a* or the cathode terminal 46*b*. The voltage outputted from the cathode terminal 68 is applied to the cathode terminal 46*a* or 46*b* of the IC coin 4.

A transmitting and receiving device 70 and an image writing device 71*a* are provided on the housing 61.

The transmitting and receiving device 70 transmits and receives (communicates by radio) value information to and from the antenna coin 48 of the IC coin 4 retained at the HP.

The image writing device (image writing portion) 71*a* is a light-emission panel for controlling writing of an image to the image display medium 45 by directing light to the image display medium 45 of the IC coin 4 retained at the HP. More specifically, the image writing device 71*a* is opposed to the front face of the IC coin 4 when the front face of the IC coin 4 retained at the HP faces to the housing 61. In this condition, the image writing device 71*a* emits light onto the image display medium 45 through the transparent cover 51. An image is thus written to the image display medium 45 using the light emitted from the image writing device 71*a*.

As illustrated in FIG. 4, a power supply 72, a solenoid 73, and an image writing device 71*b* are provided on an opposite face of the housing 62 from the housing 61.

The power supply 72 is a DC (direct current) power source for supplying source voltage to the anode terminal 67 and the cathode terminal 68.

The solenoid 73 is a driving source for driving the stopper 69. The solenoid 73 switches between projection and withdrawal of the stopper 69. The driving source for controlling the stopper 69 is not limited to the solenoid but may be a motor or the like.

The image writing device (image writing portion) 71*b* is, similarly to the image writing device 71*a*, a light-emission panel for controlling writing of an image to the image display medium 45 by directing light to the image display medium 45 of the IC coin 4 retained at the HP. More specifically, the image writing device 71*b* is opposed to the front face of the IC coin 4 when the front face of the IC coin 4 retained at the HP faces to the housing 62. In this condition, the image writing device 71*b* emits light onto the image display medium 45 through the transparent cover 51. An image is thus written to the image display medium 45 using the light emitted from the image writing device 71*b*.

Thus, the back face of the IC coin 4 is opposed to the image writing device 71*b* when the front face of the IC coin 4 is opposed to the image writing device 71*a*, and the front face of the IC coin 4 is opposed to the image writing device 71*b* when the back face of the IC coin 4 is opposed to the image writing device 71*a*. In other words, the recording medium processing device 20 has two image writing devices 71 one of which is opposed to the front face and the other of which is opposed to the back face of the IC coin 4 retained at the HP. It is thus possible to write an image to the image display medium 45 by directing light thereto through the transparent cover 51 either when the front face of the IC coin 4 is opposed to the housing 61 and the back face of the IC coin 4 is opposed to the housing 62 or when the front face of the IC coin 4 is opposed to the housing 62 and the back face of the IC coin 4 is opposed to the housing 61.

Figure 6:
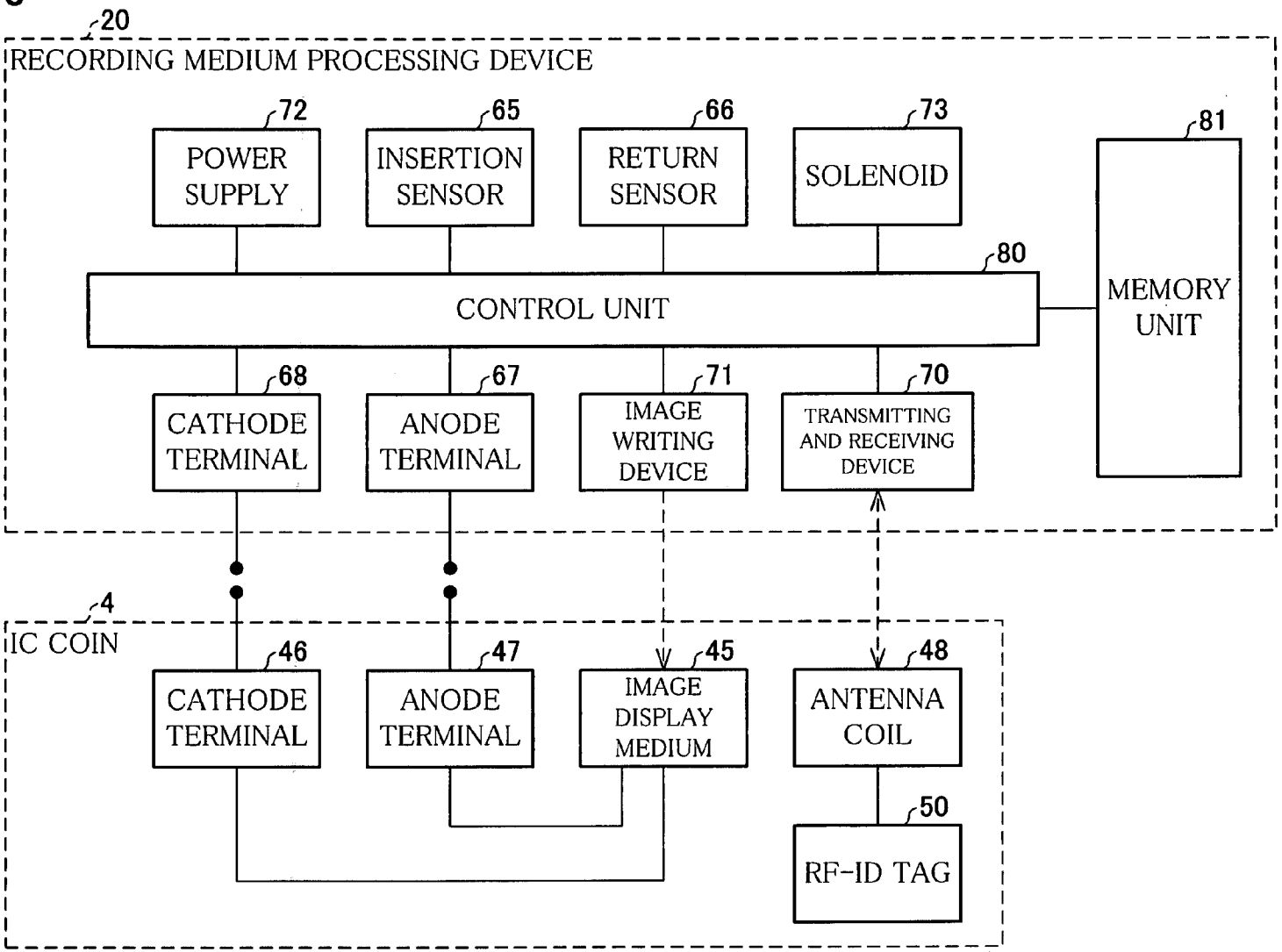
FIG. 6 is a function block diagram of respective components of the recording medium processing device and the IC coin shown in FIG. 5.

As shown in FIG. 6, a control unit 80 collectively controls the power supply 72, the insertion sensor 65, the return sensor 66, the anode terminal 67, the cathode terminal 68, the transmitting and receiving device 70, the image writing devices 71, and the solenoid 73.

More specifically, the control unit 80 reads value information recorded on the RF-ID tag 50 via the transmitting and receiving device 70 and the antenna coil 48. Then, the control unit 80 stores the value information thus read out in a memory unit 81 shown in FIG. 6.

The control unit 80 updates the value information stored in the memory unit 81 every time the pinball supply machine 2 supplies pinballs and also updates the value information stored in the RF-ID tag 50. The control unit 80 is also capable of writing an image to the image display medium 45 by applying voltage to the image display medium 45 through the cathode terminals 46 and 68 and the anode terminals 47 and 67 and driving the image writing devices 71.

(Flow of Processing)

Figure 7:
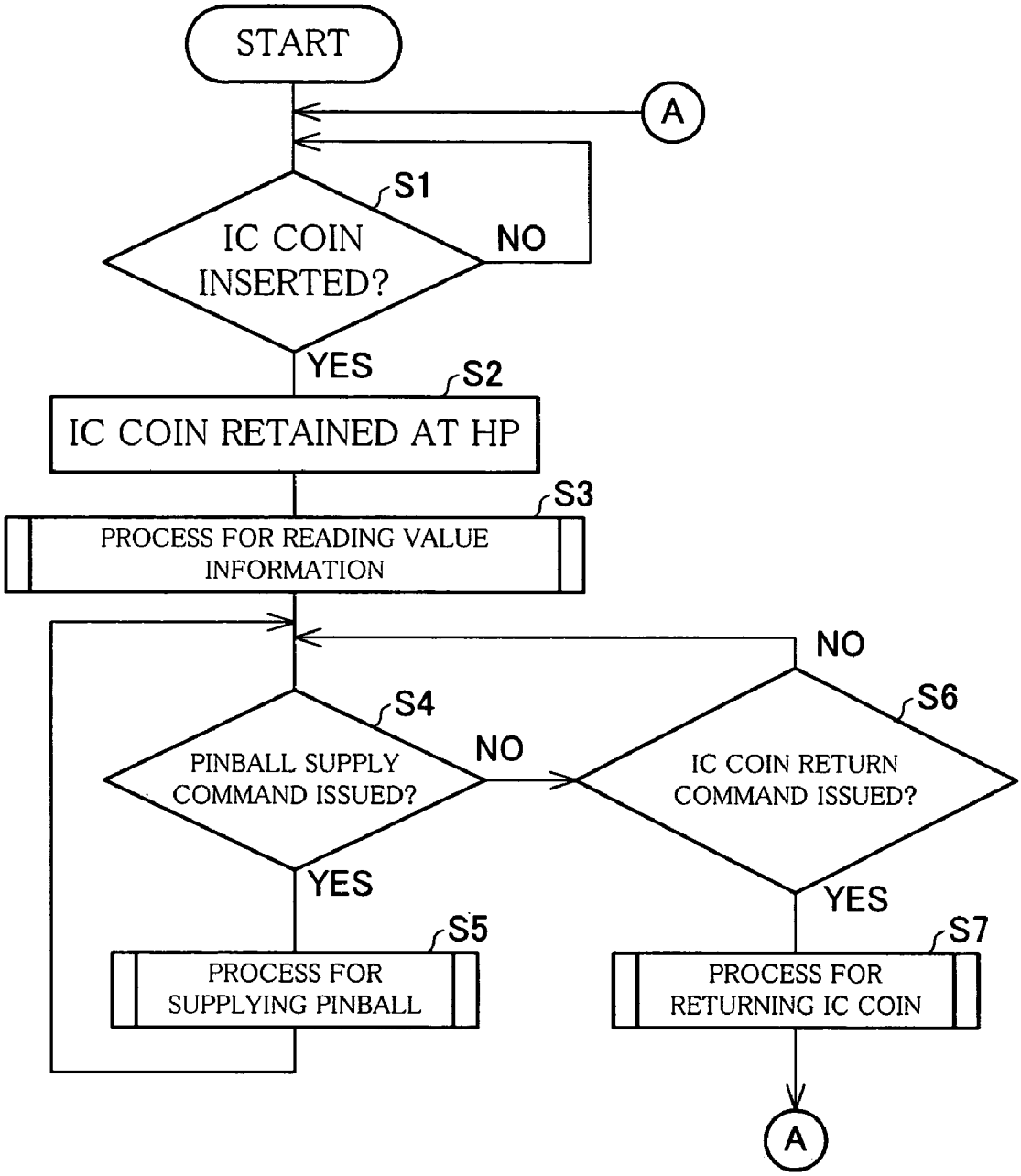
FIG. 7 is a flowchart showing entire processing of a pinball play service in the first embodiment according to the invention.

Next, the flow of the entire processing of the recording medium processing device 20 in this embodiment is described referring to FIG. 7. When a user inserts the IC coin 4 through the IC coin inlet 6, the control unit 80 detects insertion of the IC coin 4 based on the output from the insertion sensor 65 ("YES" in step S1) and drives the solenoid 73 to project the stopper 69. Thus, the inserted IC coin 4 is retained at the HP as illustrated in FIG. 5 (step S2).

Then, the control unit 80 reads the value information recorded on the IC coin 4 retained at the HP (step S3).

Subsequently, the control unit 80 judges whether a pinball supply command has been issued from the pinball supply input unit 9 (step S4). When it is determined that the pinball supply command has been issued ("YES" in step S4), the control unit 80 supplies pinballs (step S5). After pinballs are supplied in step S5, the process in step S4 is repeated. When it is determined that the pinball supply command has not been issued ("NO" in step S4), the process goes to step S6.

In step S6, the control unit 80 judges whether a return command has been inputted from the return switch 10. When it is determined that the return command has been inputted from the return switch 10 ("YES" in step S6), the control unit 80 returns the IC coin 4 (step S7). After the IC coin 4 is returned, the process goes back to step S1 to repeat the above-described processing. When it is determined that the return command has not been inputted from the return switch 10 ("NO in step S6), the process in step S4 is repeated.

Figure 8:
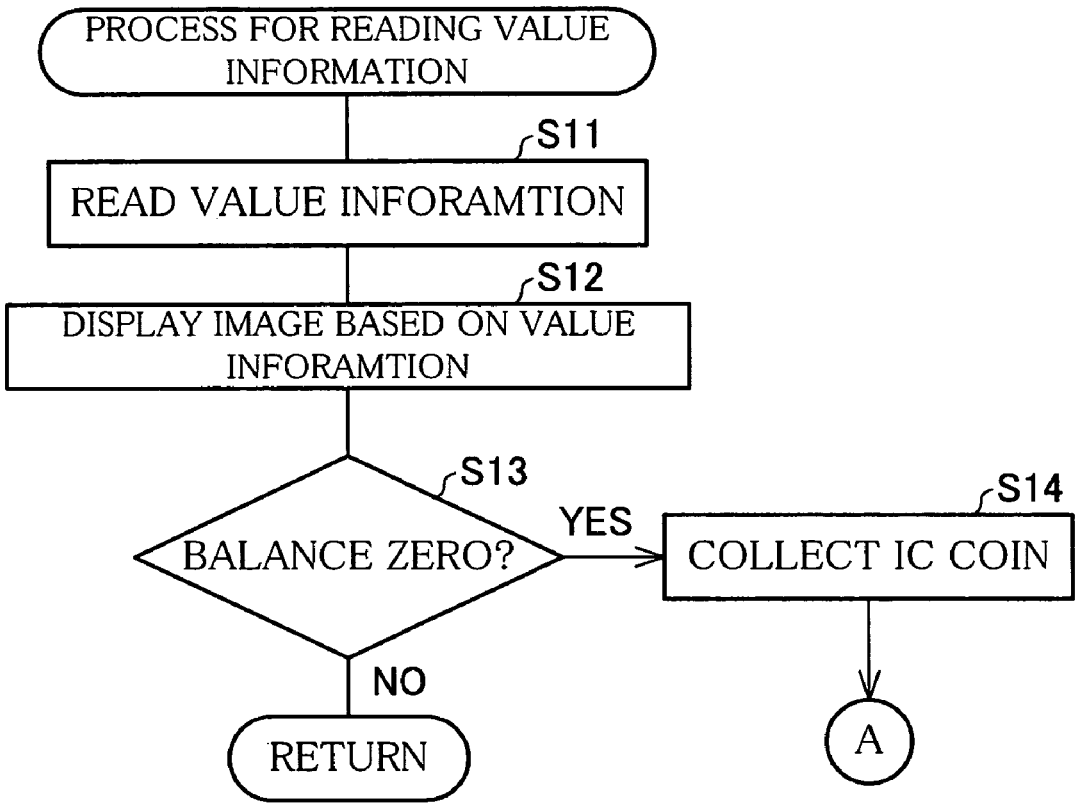
FIG. 8 is a flowchart showing a process for reading value information shown in FIG. 7 in more detail.

Next, the process for reading the value information in step S3 shown in FIG. 7 is described in more detail. FIG. 8 is a flowchart showing the details of the process for reading the value information in step S3.

First, the control unit 80 reads the value information recorded on the RF-ID tag 50 of the IC coin 4 through the transmitting and receiving device 70 and the antenna coil 48 (step S11). The control unit 80 stores the value information in the memory unit 81. The control unit 80 also displays on the pinball supply display unit 8 the number of pinballs calculated from the monetary value shown in the value information stored in the memory unit 81 (step S12).

Then, the control unit 80 analyzes the value information stored in the memory unit 81 and judges whether the monetary value (balance) shown in the value information is zero or not (step S13). When it is determined that the monetary value is zero ("YES" in step S13), the control unit 80 collects the IC coin 4 (step S14).

The control unit 80 in the step for collecting the IC coin 4 drives the solenoid 73 to withdraw the stopper 69. Simultaneously, the control unit 80 switches the traveling course of the IC coin 4 in the passage 64 such that the IC coin 4 moves to the collecting box. This allows the IC coin 4 to be collected into the collecting box. The processing then returns to step S1. When it is determined that the monetary value shown in the value information is not zero in step S13 ("NO" in step S13), the process for reading the value information in step S3 ends.

Figure 9:
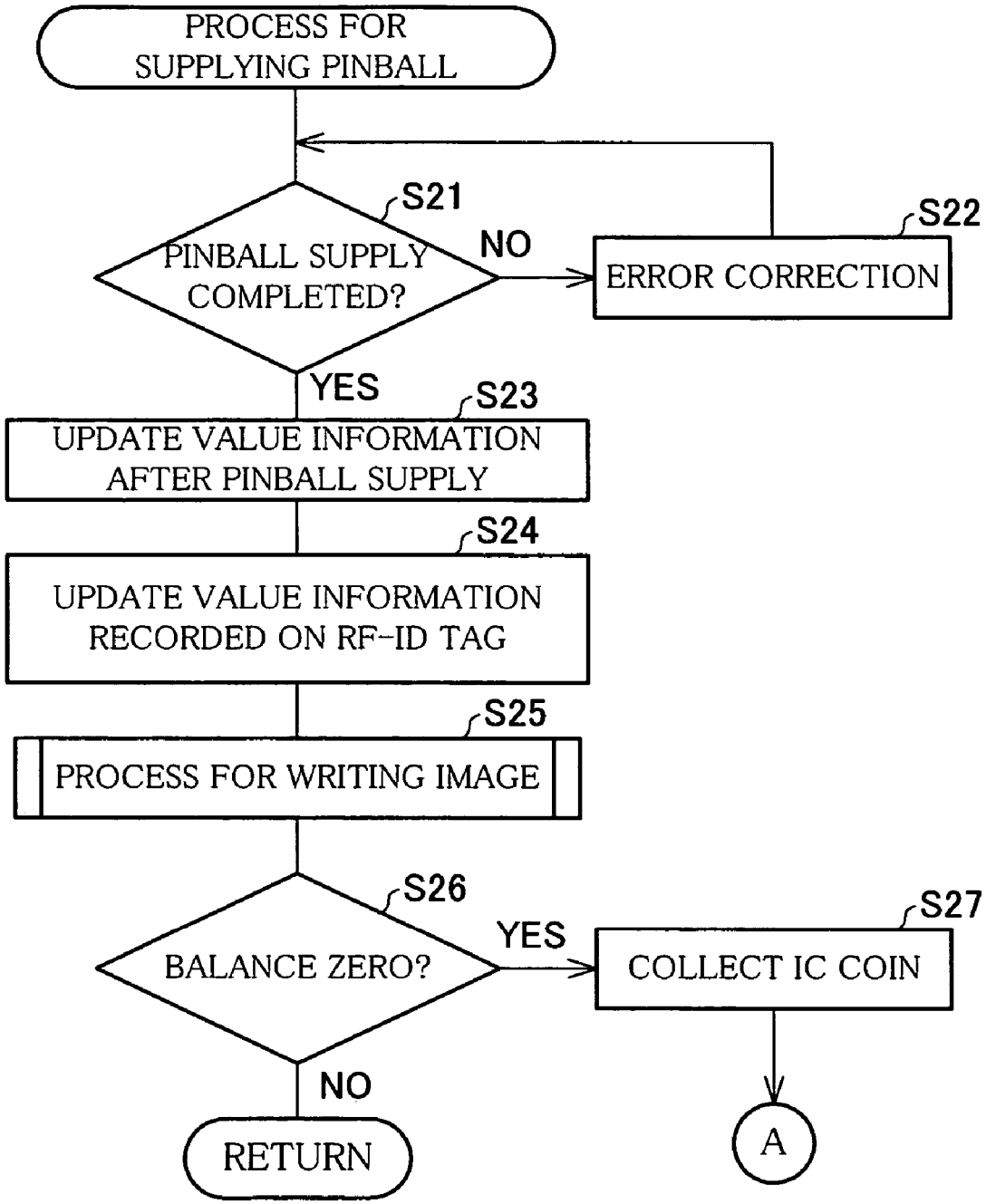
FIG. 9 is a flowchart showing a process for supplying pinballs shown in FIG. 7 in more detail.

Next, the process for supplying pinballs in step S5 shown in FIG. 7 is described in more detail in conjunction with FIG. 9. FIG. 9 is a flowchart showing the details of the process for supplying pinballs in step S5.

First, the control unit 80 judges whether supply of pinballs by the pinball supply machine 2 is completed (step S21). When it is determined the supply of pinballs is not completed ("NO" in step S21), a process for correcting errors such as pinball jamming is executed (step S22).

When it is determined that the supply of pinballs is completed ("YES" in step 21), the control unit 80 detects the number of pinballs supplied, and updates the value information stored in the memory unit 81 based on the detected information (step S23). Based on the updated value information, the control unit 80 updates the value information recorded on the RF-ID tag 50 of the IC coin 4 through the transmitting and receiving device 70 and the antenna coil 48 (step S24).

Then, the control unit 80 writes an image based on the updated value information to the image display medium 45 of the IC coin 4 (step 25). Subsequently, the control unit 80 analyzes the updated value information and judges whether the monetary value (balance) shown in the value information is zero or not (step S26). When it is determined that the monetary value is zero ("YES" in step S26), the control unit 80 collects the IC coin 4 (step S27). The process for collecting the IC coin 4 in step S27 is the same process as that in step S14. The processing then returns to step S1. When it is determined that the monetary value is not zero in step 26 ("NO" in step 26), the process for supplying pinballs ends.

Figure 10:
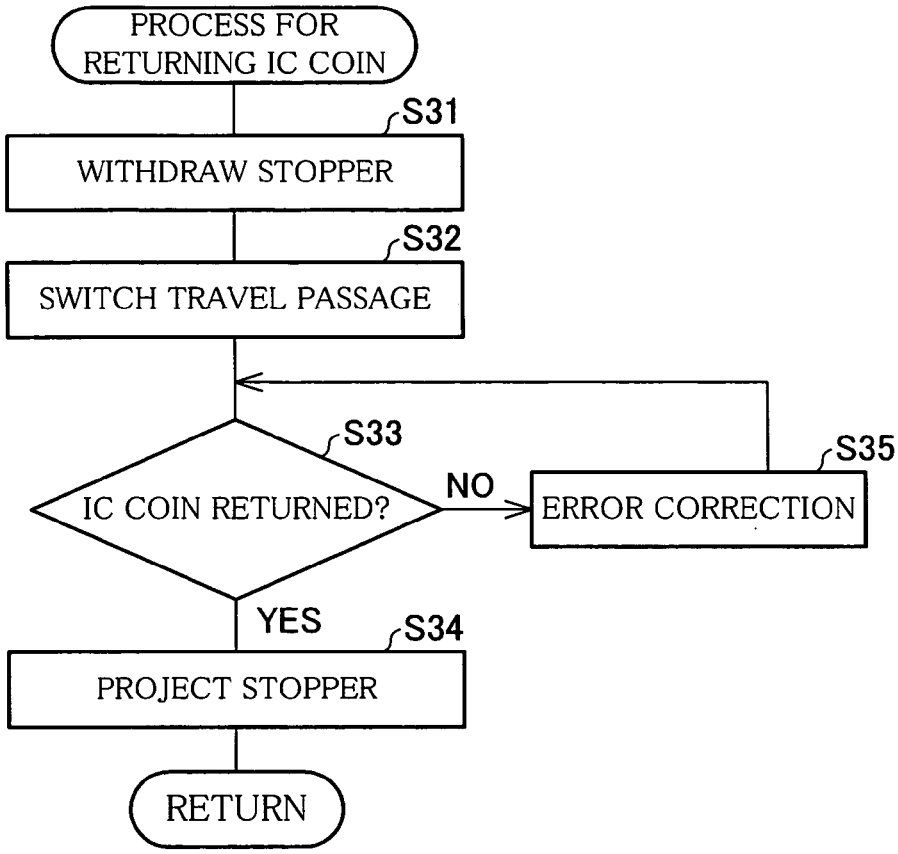
FIG. 10 is a flowchart showing a process for returning the IC coin shown in FIG. 7 in more detail.

Next, the process for returning the IC coin 4 in step S7 shown in FIG. 7 is described in more detail in conjunction with FIG. 10. FIG. 10 is a flowchart showing the details of the process for returning the IC coin 4 in step S7.

First, the control unit 80 drives the solenoid 73 to withdraw the stopper 69 (step S31). Simultaneously, the control unit 80 controls a switching mechanism (not shown) to switch the travel course of the IC coin 4 in the passage 64 such that the IC coin 4 moves to the IC coin outlet 7. This process allows the IC coin 4 to reach the IC coin outlet 7.

When the control unit 80 detects the return of the IC coin 4 by the return sensor 66 ("YES" in step S33), the control unit 80 drives the solenoid 73 to project the stopper 69 (step S34) and end the IC coin return process. When the control unit 80 does not detect the return of the IC coin 4 ("NO" in step S33), a process for correcting errors such as coin jamming is executed (step S35).

Figure 11:
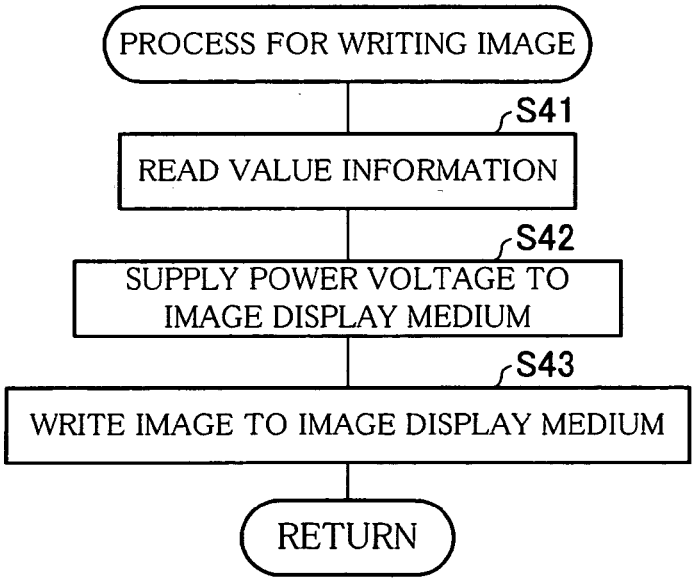
FIG. 11 is a flowchart showing a process for writing an image shown in FIG. 9 in more detail.

Next, the process for writing an image in step S25 shown in FIG. 9 is described in more detail with reference to FIG. 11. FIG. 11 is a flowchart showing the details of the process for writing an image in step S25.

First, the control unit 80 reads the value information stored in the memory unit 81 (step S41). That is, the control unit 80 reads the value information updated in the step for supplying pinballs.

Then, the control unit 80 supplies power voltage outputted from the power supply 72 to the image display medium 45 through the anode terminals 47 and 67 and the cathode terminals 46 and 68 (step S42). Subsequently, the control unit 80 drives the image writing devices 71 to write the image to the image display medium 45 based on the value information read out in step S41 (step S43) and ends the process for writing the image.

Figure 12:
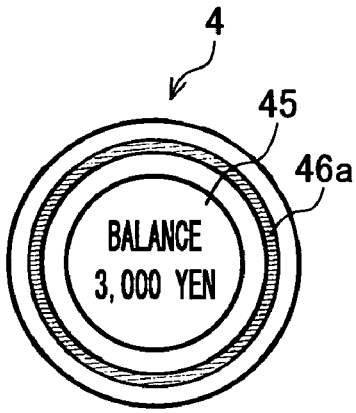
FIG. 12 illustrates an image displayed on the IC coin shown in FIG. 1.

According to the above-described procedures, the value information recorded on the RF-ID tag 50 of the IC coin 4 is updated and the image based on the updated value information is displayed on the image display medium 45 every time the value information is updated in the process for supplying pinballs. Thus, the content of the value information recorded on the RF-ID tag 50 of the IC coin 4 always coincides with the image displayed on the image display medium 45 of the IC coin 4. For example, when the monetary value shown in the value information recorded on the RF-ID tag 50 of the IC coin 4 is 3,000 yen, an image indicating 3,000 yen is displayed on the image display medium 45 of the IC coin 4 as illustrated in FIG. 12.

Figure 13:
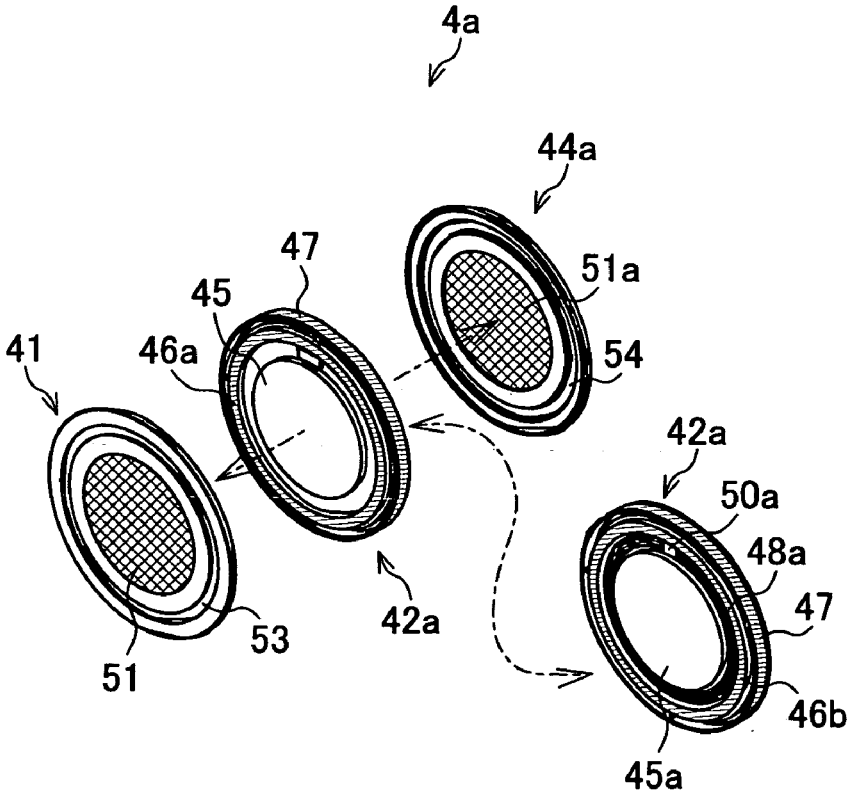
FIG. 13 is a perspective view of a disassembled IC coin which displays images on both faces in the first embodiment according to the invention.

While an image is displayed on one side of the IC coin 4 (i.e., an image can be visually checked from the front cover 41 side) in this embodiment, images may be displayed on both sides of an IC coin. An IC coin 4*a* capable of displaying images on both sides is now described with reference to FIG. 13. In FIG. 13, similar reference numerals are given to similar components to those shown in FIG. 1 and differences from the IC coin 4 shown in FIG. 1 are chiefly described in the following explanation.

As illustrated in FIG. 13, the IC coin 4*a* (coin-shaped recording medium) is formed by stacking the front cover 41, a coin main body 42*a*, and a rear cover 44*a* in this order each of which parts is disk-shaped and has the same radius. In the figure, the coin main body 42*a* is shown in two ways to show different faces.

The face of the coin main body 42*a* facing to the front cover 41 and the side of the coin main body 42*a* have the same structures as those of the coin main body 42 shown in FIG. 1. However, a ring-shaped antenna coil 48*a*, an image display medium 45*a* formed within the inner periphery of the antenna coil 48*a*, an RF-ID tag 50*a* mounted on the antenna coil 48*a*, and the cathode terminal 46*b* encircling the outer periphery of the antenna coil 48*a* are provided on the other face of the coin main body 42*a* facing to the rear cover 44*a*.

The rear cover 44*a* is a cover for protecting the inside of the IC coin 4*a*, and is constituted by a disk-shaped transparent cover 51*a* having a smaller diameter than that of the rear cover 44*a*, and the electrode window 54 which is open and encircles the outer periphery of the transparent cover 51*a*.

The face of the coin main body 42*a* on which the image display medium 45*a* and the cathode terminal 46*b* are formed is opposed to the rear cover 44*a*. The rear cover 44*a* has the transparent cover (transparent material) 51*a* in such a position as to be opposed to the image display medium (second image display medium) 45*a*, and the electrode window 54 in such a position as to be opposed to the cathode terminal 46*b*.

In the IC coin 4*a*, the image display medium 45 can be visually checked through the transparent cover 51 from the font face (the face having the front cover 41), and the image display medium 45*a* can be visually checked through the transparent cover 51*a* from the back face (the face having the rear cover 44*a*).

Figure 14A:
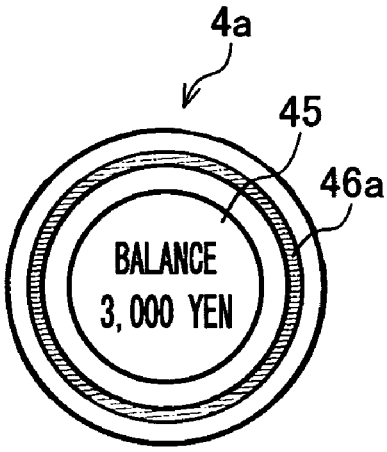
Figure 14B:
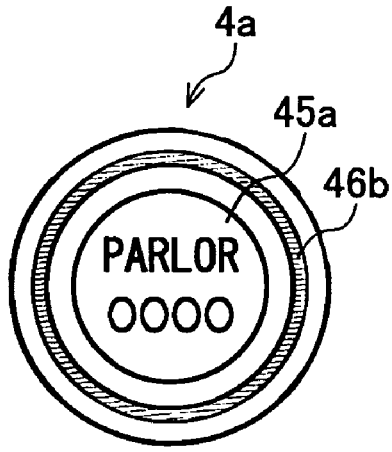

By using the IC coin 4*a* which displays images on both sides, an image corresponding to value information can be displayed on the image display medium 45 which is visually checked from the front face, and other information can be displayed on the image display medium 45*a* which is visually checked from the back face. For example, monetary information may be displayed on the image display medium 45 of the IC coin 4*a* as illustrated in FIG. 14A, and a shop name may be displayed on the image display medium 45*a* of the IC coin 4*a* as illustrated in FIG. 14B.

Figure 14C:
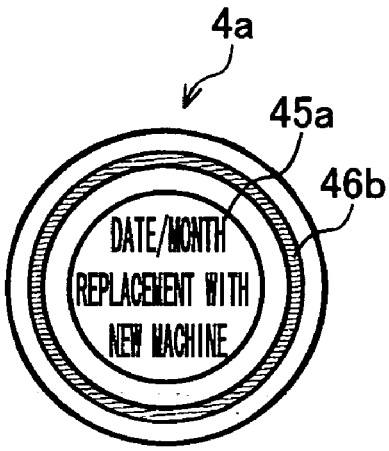
Figure 14D:
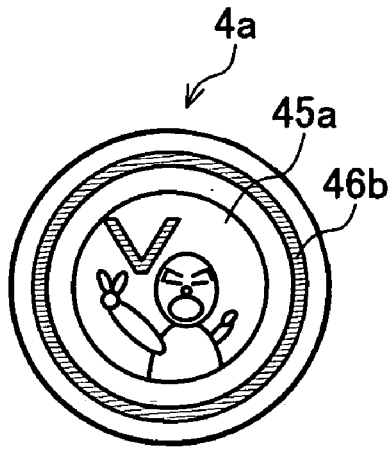

As other displayable information, information on an event held in a shop as illustrated in FIG. 14C, or a picture as illustrated in FIG. 14D may be displayed, for example.

For processing the above-described IC coin 4*a* which displays images on both sides by the recording medium processing device 20, an image based on the value information is written every time the value information is updated, and an image other than that image is written after a command of returning the IC coin 4*a* is inputted from the return switch 10 and before the IC coin 4 is returned.

In the above-described IC coin 4 or 4*a*, a cathode terminal may be disposed at a position where the anode terminal 47 is located, and an anode terminal may be disposed at a position where the cathode terminal 46 is located. In this structure of the recording medium processing device 20, an anode terminal is disposed at a position where the cathode terminal 68 is located, and a cathode terminal is disposed at a position where the anode terminal 67 is located.

In this embodiment, the E-paper is used as the image display medium. However, any display media may be employed as long as an image can be written on those by applying voltage thereto. For example, a display unit (7 segments), chips for controlling the display unit, and a battery for maintaining a displayed image may be carried on the IC coin 4 or 4*a*. In this structure, serial signals are transmitted from the recording medium processing device 20 to the chips so as to light up pixels whose addresses are designated in advance in the display unit and thereby display an image.

Embodiment 2

Another embodiment according to the invention is herein described in conjunction with FIGS. 15 through 20.

While the anode terminal 47 is provided on the side of the IC coin 4 and the cathode terminals 46 are provided on the front and back faces of the IC coin 4 in Embodiment 1, an anode terminal is disposed at the center of the front face of an IC coin and a cathode terminal is disposed at the center of the back face of the IC coin in this embodiment.

(Structure of IC Coin)

Figure 15A:
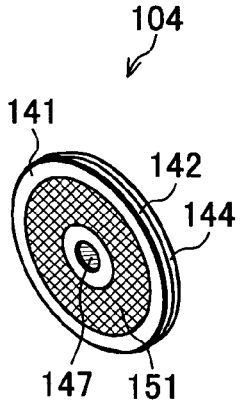

A structure of an IC coin (coin-shaped recording medium) 104 in this embodiment is now specifically described. FIG. 15A is a perspective view of the IC coin 104, and FIG. 15B is a perspective view of the IC coin 104 which is disassembled.

Figure 15B:
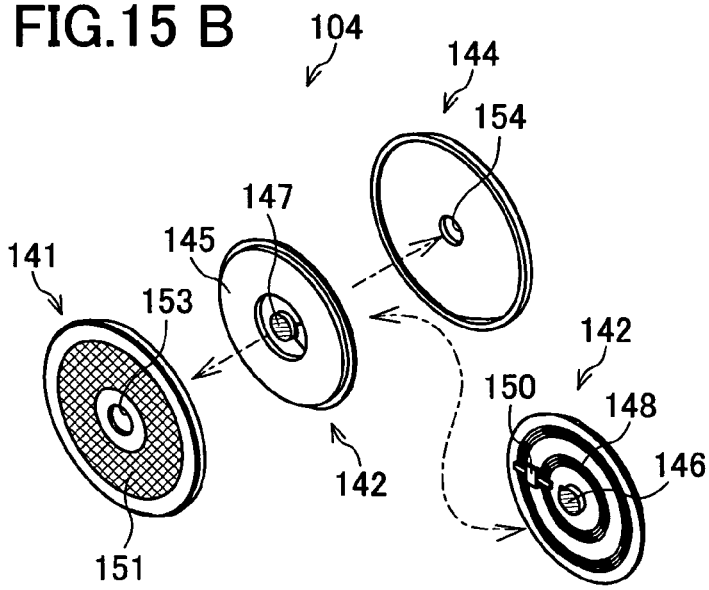

As illustrated in FIG. 15B, the IC coin 104 is formed by stacking a front cover 141, a coin main body 142, and a rear cover 144 in this order each of which parts is disk-shaped and has the same radius. In the figure, the coin main body 142 is shown in two ways to show different faces.

A ring-shaped image display medium 145, and a cathode terminal 147 which is disposed at the center of the coin main body 142 and within the inner periphery of the image display medium 145 are provided on one face of the coin main body 142. A ring-shaped antenna coil (transmitting and receiving portion) 148, an anode terminal 146 which is disposed at the center of the coin main body 142 and within the inner periphery of the antenna coil 148, and an RF-ID tag (recording circuit) 150 mounted on the antennal coil 148 are provided on the other face of the coil main body 142.

The front cover 141 is a cover for protecting the inside of the IC coin 104, and is constituted by a ring-shaped transparent cover 151, and an electrode window 153 which is disposed within the inner periphery of the transparent cover 151 and opens at the center of the front cover 141. It is assumed herein that the face of the IC coin 104 on which the front cover 141 is formed is the front face of the IC coin 104.

The rear cover 144 is a non-transparent resin cover for protecting the inside of the IC coin 104. The rear cover 144 has an electrode window 154 which opens at the center of the rear cover 144. It is assumed herein that the face of the IC coin 104 on which the rear cover 144 is formed is the back face of the IC coin 104.

The face of the coin main body 142 on which the image display medium 145 and the cathode terminal 147 are provided is opposed to the front cover 141. The transparent cover (transparent component) 151 of the front cover 141 is disposed in such a position as to be opposed to the image display medium (first image display medium, image display portion) 145, and the electrode window 153 of the front cover 141 is disposed in such a position as to be opposed to the cathode terminal 147.

The face of the coin main body 142 on which the anode terminal 146 is provided is opposed to the rear cover 144. The electrode window 154 of the rear cover 144 is disposed in such a position as to be opposed to the anode terminal 146.

Figure 19:
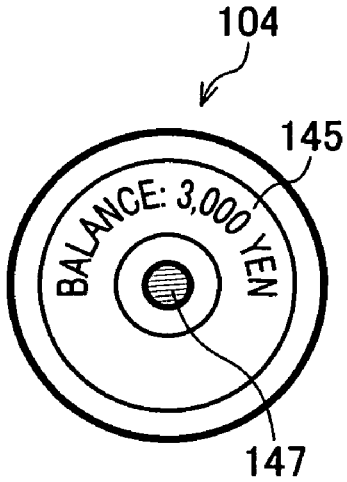
FIG. 19 illustrates an image displayed on the IC coin shown in FIGS. 15A and 15B.

When the IC coin 104 is formed by stacking the front cover 141, the coin main body 142, and the rear cover 144 each having the above structure as illustrated in FIG. 15A, the cathode terminal (first type electrode, voltage input portion) 147 disposed at the center of the front face (face having the front cover 141) of the IC coin 104 is exposed to the outside through the electrode window 153. The anode terminal (second type electrode, voltage input portion) 146 disposed at the center of the back face (face having the rear cover 144) of the IC coin 104 is exposed to the outside through the electrode window 154. In this structure, the image display medium 145 on the front face of the IC coin 104 can be visually checked from outside through the transparent cover 151. FIG. 19 illustrates an image corresponding to value information displayed on the image display medium 145 of the IC coin 104.

While an image is displayed on one side of the IC coin 104 (i.e., an image can be visually checked from the front cover 141 side) in this embodiment, images may be displayed on both sides of an IC coin. An IC coin 104*a* capable of displaying images on both sides is now described with reference to FIGS. 16A and 16B. In these figures, similar reference numerals are given to similar components to those shown in FIGS. 15A and 15B and differences from the IC coin 104 shown in FIGS. 15A and 15B are chiefly described in the following explanation.

Figure 16A:
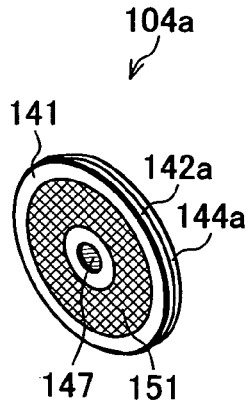
Figure 16B:
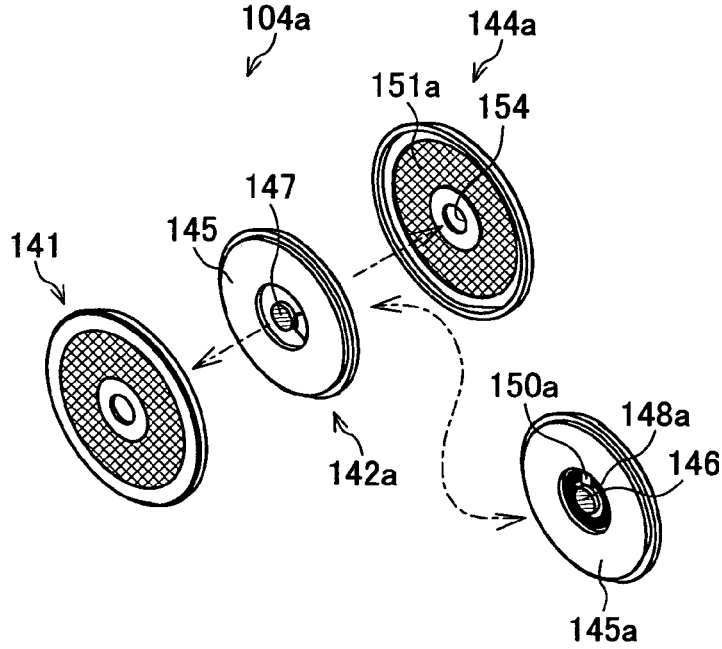

As illustrated in FIG. 16B, the IC coin 104*a* is formed by stacking the front cover 141, a coin main body 142*a*, and a rear cover 144*a* in this order each of which parts is disk-shaped and has the same radius.

The face of the coin main body 142*a* facing to the front cover 141 has the same structure as that of the coin main body 142 shown in FIGS. 15A and 15B. However, a ring-shaped image display medium 145*a*, a ring-shaped antenna coil 148*a* disposed within the inner periphery of the image display medium 145*a*, the anode terminal 146 positioned within the inner periphery of the antenna coil 148*a* and at the center of the coin main body 142*a*, and an RF-ID tag 150*a* mounted on the antenna coil 148*a* are provided on the other face of the coin main body 142*a* facing to the rear cover 144.

The rear cover 144*a* is a cover for protecting the inside of the IC coin 104*a*, and is constituted by a ring-shaped transparent cover 151*a*, the electrode window 154 which is open within the inner periphery of the transparent cover 151*a* and at the center of the rear cover 144*a*.

The face of the coin main body 142*a* on which the image display medium 145*a* and the anode terminal 146 are formed is opposed to the rear cover 144*a*. The transparent cover (transparent material) 151*a* of the rear cover 144*a* is disposed in such a position as to be opposed to the image display medium (second image display medium) 145*a*, and the electrode window 154 of the rear cover 144*a* is disposed in such a position as to be opposed to the anode terminal 146.

When the IC coin 104*a* is formed by stacking the front cover 141, the coin main body 142*a*, and the rear cover 144*a* each having the above structure as illustrated in FIG. 16A, the cathode terminal 147 disposed at the center of the front face of the IC coin 104*a* (face having the front cover 141) is exposed to the outside through the electrode window 153. The anode terminal 146 disposed at the center of the back face of the IC coin 104*a* (face having the rear cover 144*a*) is exposed to the outside through the electrode window 154.

In the IC coin 104*a*, the image display medium 145 can be visually checked from the front face (face having the front cover 141) through the transparent cover 151. Also, the image display medium 145*a* can be visually checked from the back face (face having the rear cover 144*a*) through the transparent cover 151*a*.

Figure 20A:
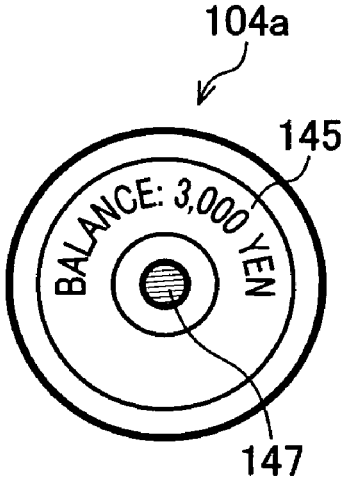
Figure 20B:
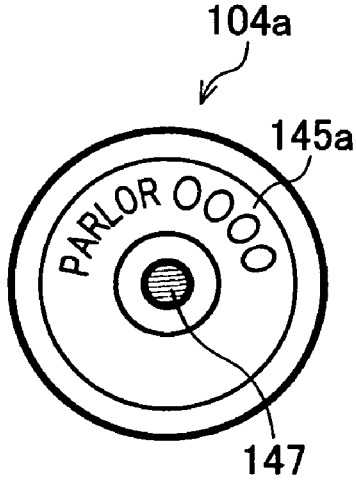

By using the IC coin 104*a* which displays images on both sides, an image corresponding to value information can be displayed on the image display medium 145 which is visually checked from the front face, and other information can be displayed on the image display medium 145*a* which is visually checked from the back face. For example, monetary information may be displayed on the image display medium 145 of the IC coin 104*a* as illustrated in FIG. 20A, and a shop name may be displayed on the image display medium 145*a* of the IC coin 104*a* as illustrated in FIG. 20B.

(Structure of Recording Medium Processing Device)

Next, a recording medium processing device 220 employed for the IC coin 104 shown in FIGS. 15A and 15B or the IC coin 104*a* shown in FIGS. 16A and 16B is described.

Figure 17B:
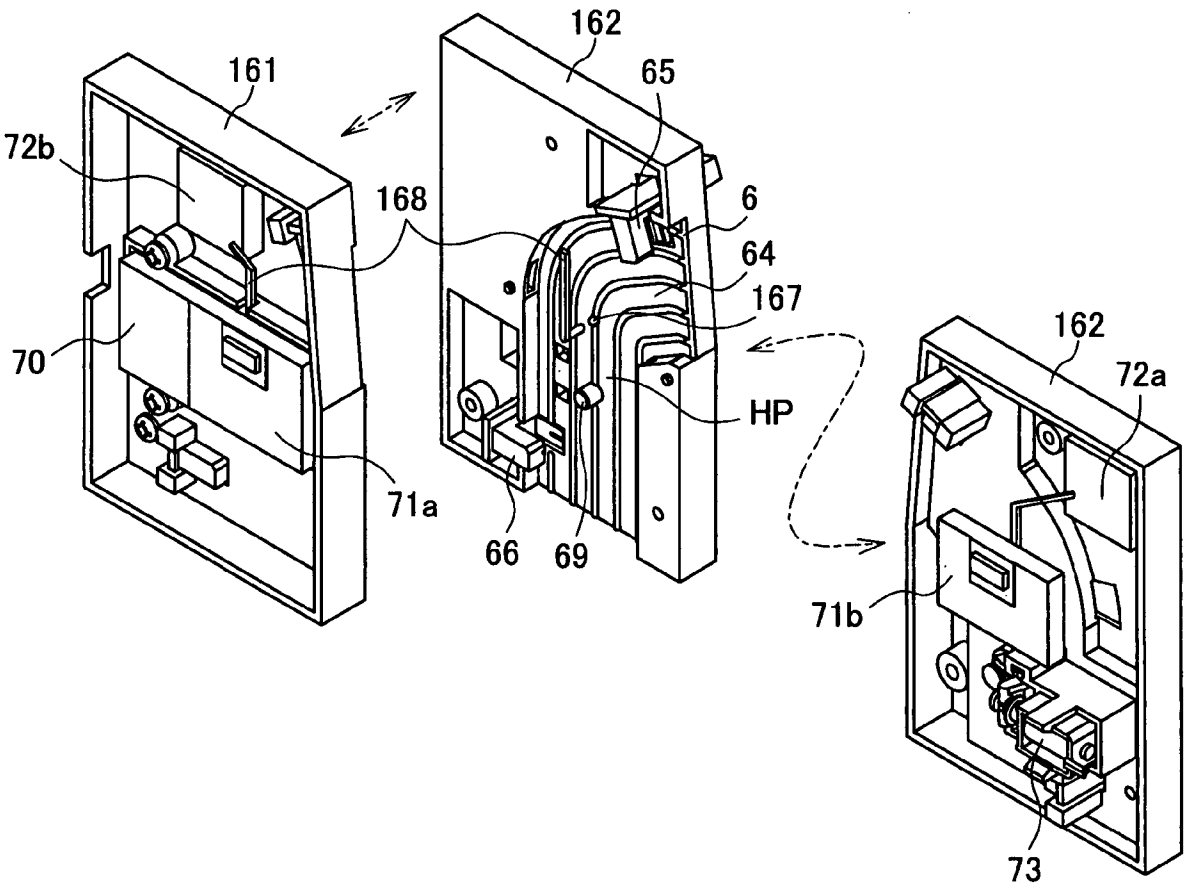
Figure 17A:
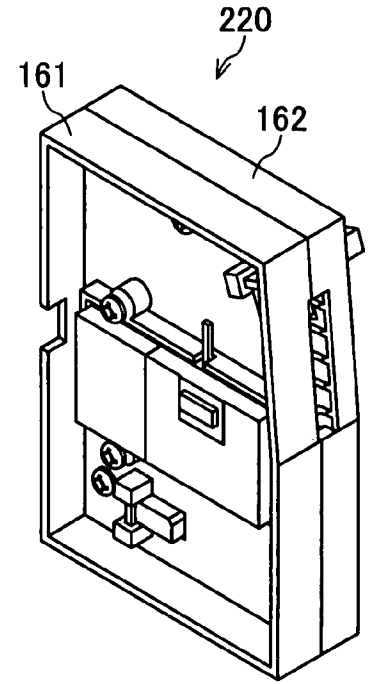

FIG. 17A is a perspective view of an external appearance of the recording medium processing device 220, and FIG. 17B is a perspective view of an inside structure of the disassembled recording medium processing device 220. As illustrated in FIG. 17A, the recording medium processing device 220 is formed by joining a housing 161 and a housing 162. In FIG. 17B, the housing 162 is shown in two ways to show different faces.

The passage 64, the insertion sensor 65, the return sensor 66, an electrode terminal 167, and the stopper 69 are provided on one face of the housing 162 facing to the housing 161. The passage 64, the insertion sensor 65, the return sensor 66, and the stopper 69 are similar to those in Embodiment 1, and the explanation of those is herein omitted. An electrode terminal 168 is provided on the face of the housing 161 facing to the housing 162.

The electrode terminals (voltage applying portion) 167 and 168 are terminals for applying voltage, which are formed on the passage 64 to be opposed to each other. The electrode terminals 167 and 168 are disposed in such positions as to contact the center of the front face or the back face of the IC coin 104 when the IC coin 104 is retained at the HP. More specifically, the electrode terminal 168 contacts the cathode terminal 147 of the IC coin 104 when the electrode terminal 167 contacts the anode terminal 146 of the IC coin 104, and the electrode terminal 168 contacts the anode terminal 146 of the IC coin 104 when the electrode terminal 167 contacts the cathode terminal 147 of the IC coin 104.

The electrode terminal 167 is connected to a power supply 72*a* provided on an opposite face of the housing 162 from the housing 161. The electrode terminal 168 is connected to a power supply 72*b* provided on the housing 161.

In the recording medium processing device 220, a not-shown sensor detects the polarity of the electrode terminal of the IC coin 104 contacting the electrode terminal 167 and the polarity of the electrode terminal of the IC coin 104 contacting the electrode terminal 168. Then, the power supply 72*a* outputs voltage having the same polarity as that of the electrode terminal of the IC coin 104 contacting the electrode terminal 167. Also, the power supply 72*b* outputs voltage having the same polarity as that of the electrode terminal of the IC coin 104 contacting the electrode terminal 168.

Thus, the electrode terminal 167 supplies anode voltage to the anode terminal 146 when the anode terminal 146 of the IC coin 104 contacts the electrode terminal 167, and the electrode terminal 167 supplies cathode voltage to the cathode terminal 147 when the cathode terminal 147 of the IC coin 104 contacts the electrode terminal 167. On the other hand, the electrode terminal 168 supplies anode voltage to the anode terminal 146 when the anode terminal 146 of the IC coin 104 contacts the electrode terminal 168, and the electrode terminal 168 supplies cathode voltage to the cathode terminal 147 when the cathode terminal 147 of the IC coin 104 contacts the electrode terminal 168.

Figure 18:
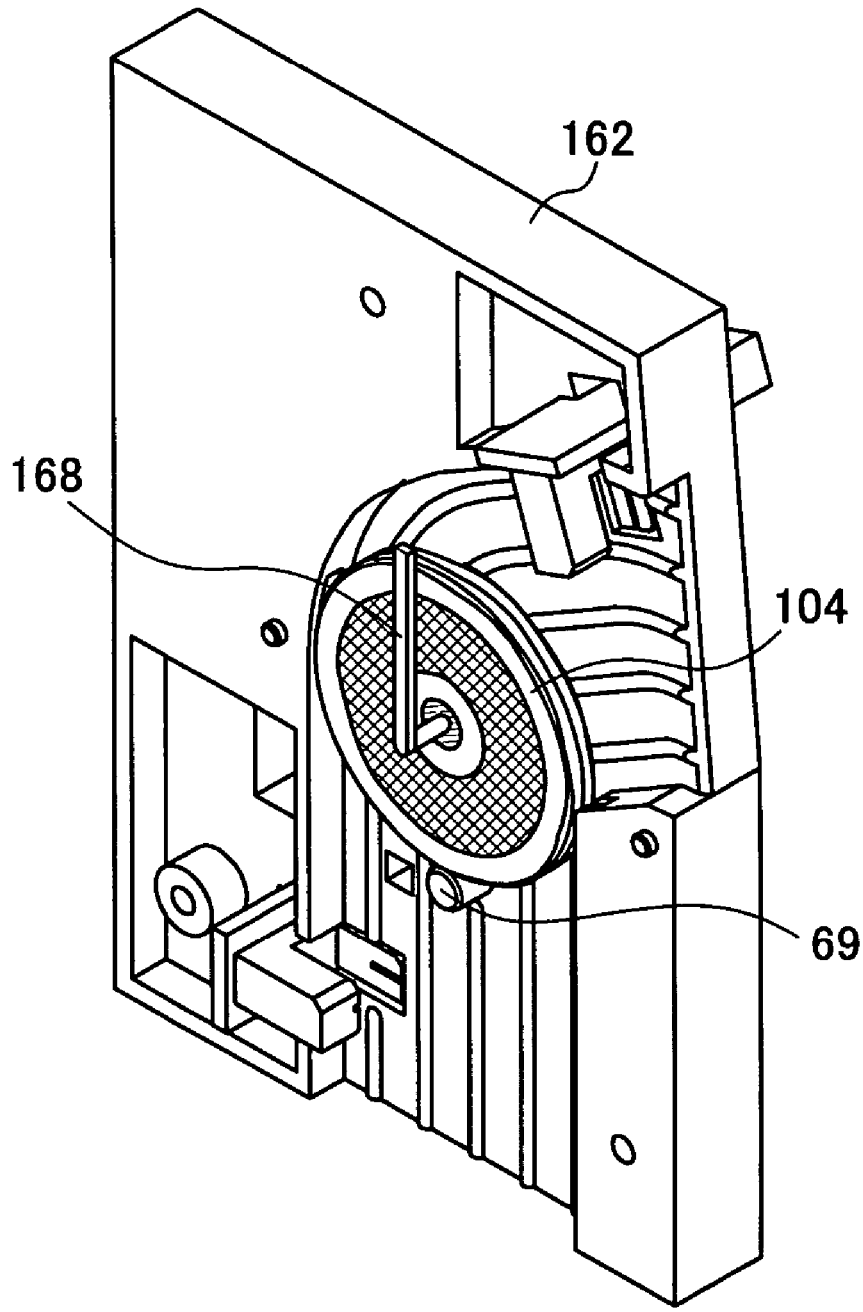
FIG. 18 is a perspective view of the recording medium processing device shown in FIGS. 17A and 17B, illustrating an inside structure of the recording medium processing device in which the IC coin is retained at the HP.

In the recording medium processing device 220 having the above structure, the IC coin 104 retained at the HP is supported by the stopper 69 and simultaneously the centers of the front face and back face of the IC coin 104 are sandwiched between the electrode terminals 167 and 168 as illustrated in FIG. 18.

The electrodes are provided at the centers of both the front face and back face of the IC coin 104. The electrode terminal 167 of the recording medium processing device 220 is disposed in such a position as to contact the center of one face of the IC coin 104, and the electrode terminal 168 is disposed in such a position as to contact the center of the other face of the IC coin 104. Accordingly, voltage can be applied to the IC coin 104 regardless of the disposition of the front face and the back face of the IC coin 104 retained at he HP.

In the IC coin 104 or 104*a*, a cathode terminal may be provided at the position of the anode terminal 146 and an anode terminal may be provided at the position of the cathode terminal 147.

Embodiment 3

A further embodiment according to the invention is hereinafter described with reference to FIGS. 21 through 27.

In this embodiment, a structure in which an anode terminal is formed on one half of the side periphery of an IC coin and a cathode terminal is formed on the other half of the side periphery of the IC coin is described.

(Structure of IC Coin)

Figure 21A:
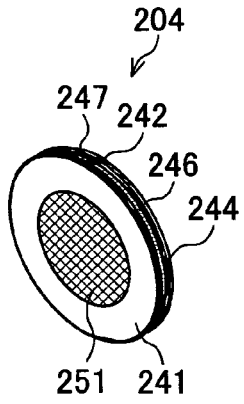

The structure of an IC coin 204 in this embodiment is specifically described. FIG. 21A is a perspective view of the IC coin 204, and FIG. 21B is a perspective view of the disassembled IC coin 204.

Figure 21B:
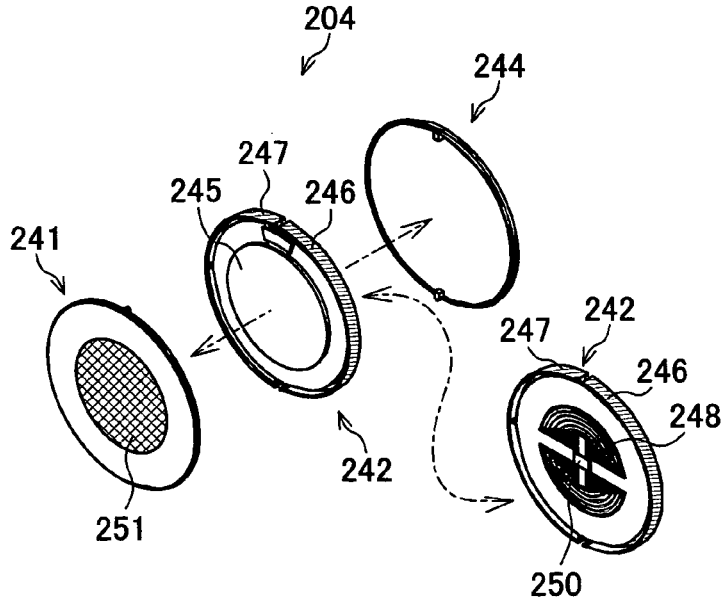

As illustrated in FIG. 21B, the IC coin 204 is formed by stacking a front cover 241, a coin main body 242, and a rear cover 244 in this order each of which parts is disk-shaped and has the same radius. In figure, the coin main body 242 is shown in two ways to show different faces.

A disk-shaped image display medium (image display portion) 245 having a smaller diameter than that of the coin main body 242 is provided on one face of the coin main body 242. A disk-shaped antenna coil (transmitting and receiving portion) 248 having a smaller diameter than that of the coin main body 242, and an RF-ID tag (recording circuit) 250 mounted on the antenna coil 248 are provided on the other face of the coin main body 242.

An anode terminal (first type electrode, voltage input portion) 246 is disposed on one half of the side periphery of the coin main body 242 to be exposed to the outside, and a cathode terminal (second type electrode, voltage input portion) 247 is disposed on the other half of the side periphery of the coin main body 242 to be exposed to the outside.

Figure 27:
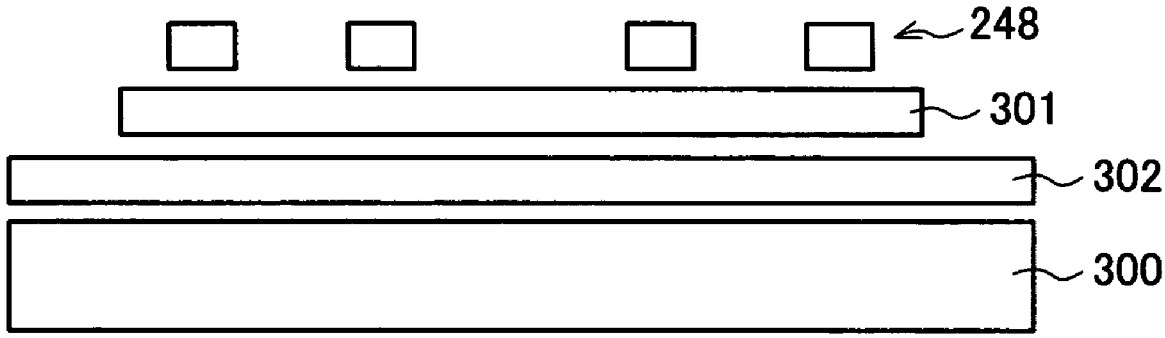
FIG. 27 is a cross-sectional view of a coin main body as a component of the IC coin shown in FIGS. 21A and 21B.

A metal body may be formed on the back of the antenna coil 248 of the coin main body 242. In this case, as shown in FIG. 27, a sheet 301 having high magnetic permeability and conductive metal 302 may be inserted between metal body 300 and the antenna coil 248 to prevent deterioration of the communication capability of the antenna coil 248 due to the metal body 300 thus formed.

The front cover 241 is a cover for protecting the inside of the IC coin 204, and has a disk-shaped transparent cover 251 having a smaller diameter than that of the front cover 241. It is assumed herein that the face of the IC coin 204 on which the front cover 241 is formed is the front face of the IC coin 204.

The rear cover 244 is a non-transparent resin cover for protecting the inside of the IC coin 204. It is assumed herein that the face of the IC coin 204 on which the rear cover 244 is formed is the back face of the IC coin 204.

The face of the coin main body 242 on which the image display medium 245 is provided is opposed to the front cover 241. The transparent cover (transparent material) 251 of the front cover 241 is disposed in such a position as to be opposed to the image display medium (first image display medium, image display portion) 245.

Figure 25:
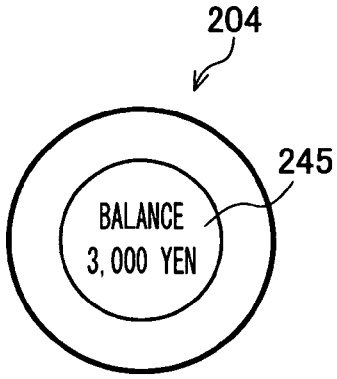
FIG. 25 illustrates an image displayed on the IC coin shown in FIGS. 21A and 21B.

When the IC coin 204 is formed by stacking the front cover 241, the coin main body 242, and the rear cover 244 each having the above structure as illustrated in FIG. 21A, the cathode terminal 247 is exposed on the one half of the side periphery of the IC coin 204 and the anode terminal 246 is exposed on the other half of the side periphery of the IC coin 204. In this structure, the image display medium 245 on the front face of the IC coin 204 can be visually checked from outside through the transparent cover 251. FIG. 25 illustrates an image corresponding to value information displayed on the image display medium 245 of the IC coin 204.

While an image is displayed on one side of the IC coin 204 (i.e., an image can be visually checked from the front cover 241 side) in this embodiment, images may be displayed on both sides of an IC coin. An IC coin 204*a* capable of displaying images on both sides is now described with reference to FIGS. 22A and 22B. In these figures, similar reference numerals are given to similar components to those shown in FIGS. 21A and 21B and differences from the IC coin 204 shown in FIGS. 21A and 21B are chiefly described in the following explanation.

Figure 22A:
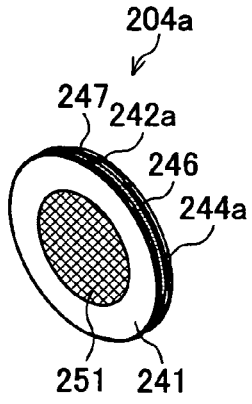
Figure 22B:
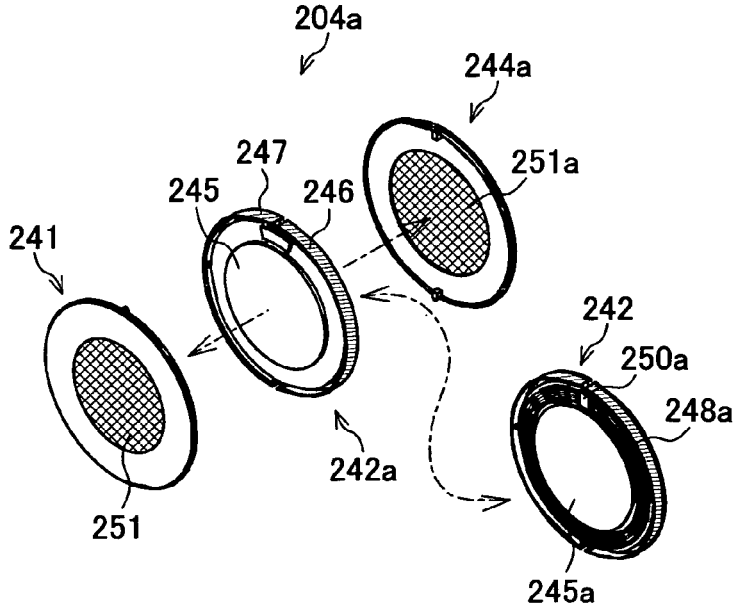

FIG. 22A is a perspective view of the IC coin 204*a*, and FIG. 22B is a perspective view of the disassembled IC coin 204*a*.

As illustrated in FIG. 22B, the IC coin 204*a* is formed by stacking the front cover 241, a coin main body 242*a*, and a rear cover 244*a* in this order each of which parts is disk-shaped and has the same radius.

The face of the coin main body 242*a* facing to the front cover 241 and the side of the coin main body 242*a* have the same structures as those of the coin main body 242 shown in FIGS. 21A and 21B. However, a ring-shaped antenna coil 248*a*, a disk-shaped image display medium 245*a* positioned within the inner periphery of the antenna coil 248*a*, and an RF-ID tag 250*a* mounted on the antenna coil 248*a* are provided on the other face of the coin main body 242*a* facing to the rear cover 244*a*.

The rear cover 244*a* is a cover for protecting the inside of the IC coin 204*a*, and has a transparent cover 251*a* having a smaller diameter than that of the rear cover 244*a*.

The face of the coin main body 242*a* on which the image display medium 245*a* is formed is opposed to the rear cover 244*a*. The transparent cover (transparent material) 251*a* of the rear cover 244*a* is disposed in such a position as to be opposed to the image display medium (second image display medium, image display portion) 245*a*.

When the IC coin 204*a* is formed by stacking the front cover 241, the coin main body 242*a*, and the rear cover 244*a* each having the above structure as illustrated in FIG. 22A, the cathode terminal 247 is exposed on the one half of the side periphery of the IC coin 204*a* and the anode terminal 246 is exposed on the other half of the side periphery of the IC coin 204*a*. The image display medium 245 on the front face of the IC coin 204*a* can be visually checked from outside through the transparent cover 251, and the image display medium 245*a* on the back face of the IC coin 204*a* can be visually checked from outside through the transparent cover 251*a*.

Figure 26A:
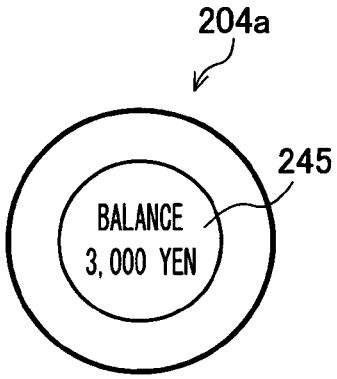
Figure 26B:
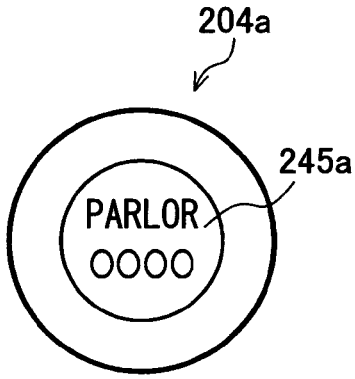
Figure 26C:
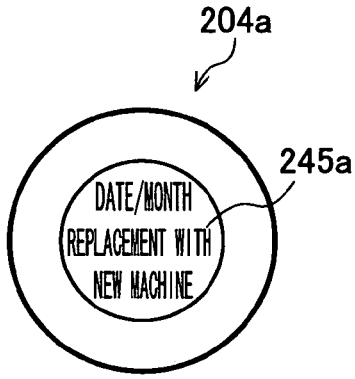

By using the IC coin 204*a* which displays images on both sides, an image based on value information can be displayed on the image display medium 245 which is visually checked from the front face, and other information can be displayed on the image display medium 245*a* which can be visually checked from the back face. For example, monetary information may be displayed on the image display medium 245 of the IC coin 204*a* as illustrated in FIG. 26A, and a shop name may be displayed on the image display medium 245*a* of the IC coin 204*a* as illustrated in FIG. 26B. Alternatively, information on an event held in a shop may be displayed on the image display medium 245*a* as illustrated in FIG. 26C.

(Structure of Recording Medium Processing Device)

Next, a recording medium processing device 320 employed for the IC coin 204 shown in FIGS. 21A and 21B or the IC coin 204*a* shown in FIGS. 22A and 22B is described.

Figure 23B:
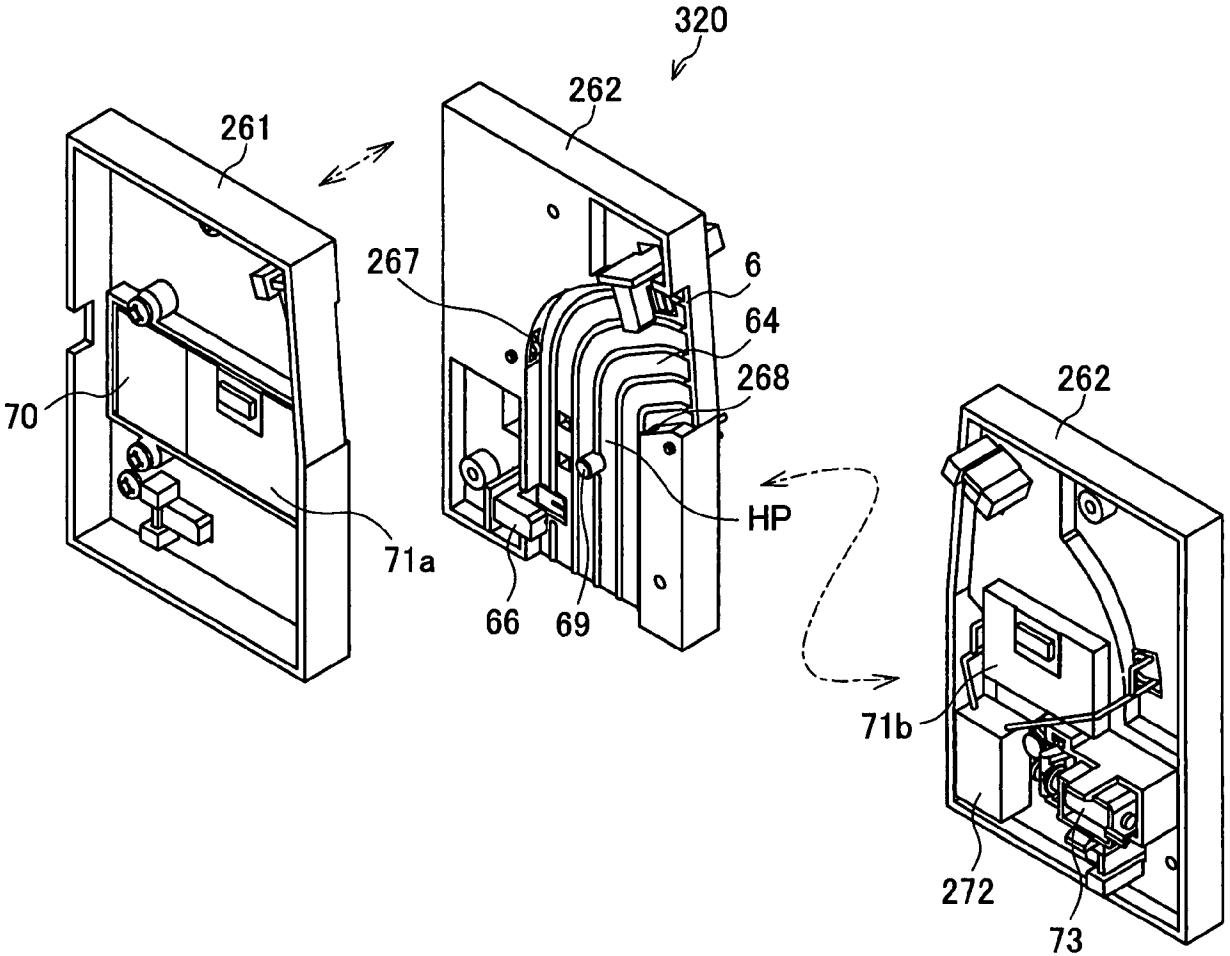
Figure 23A:
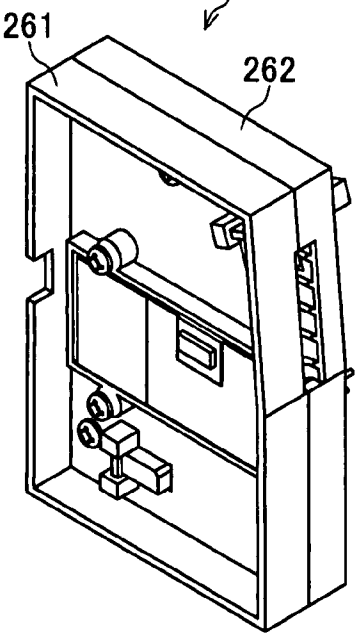

FIG. 23A is a perspective view of an external appearance of the recording medium processing device 320, and FIG. 23B is a perspective view of an inside structure of the disassembled recording medium processing device 320. As illustrated in FIG. 23A, the recording medium processing device 320 is formed by joining a housing 261 and a housing 262.

As illustrated in FIG. 23B, the passage 64, the insertion sensor 65, the return sensor 66, electrode terminals 267 and 268, and the stopper 69 are provided on one face of the housing 262 facing to the housing 261. The passage 64, the insertion sensor 65, the return sensor 66, and the stopper 69 are similar to those in Embodiment 1, and the explanation of those is herein omitted.

The electrode terminals (voltage applying portion) 267 and 268 are terminals for applying voltage, which are formed on the passage 64 to be opposed to each other. The electrode terminals 267 and 268 are disposed in such positions as to connect with the side of the IC coin 204 when the IC coin 204 is retained at the HP. That is, the electrode terminals 267 and 268 are opposed to each other with the IC coin 204 interposed therebetween while contacting the side of the IC coin 204 when the IC coin 204 is retained at the HP. More specifically, the electrode terminal 268 contacts the cathode terminal 247 provided on the side of the IC coin 204 when the electrode terminal 267 contacts the anode terminal 246 provided on the side of the IC coin 204, and the electrode terminal 268 contacts the anode terminal 246 provided on the side of the IC coin 204 when the electrode terminal 267 contacts the cathode terminal 247 provided on the side of the IC coin 204.

The electrode terminals 267 and 268 are connected to a power supply 272 provided on an opposite face of the housing 262 from the housing 261.

In the recording medium processing device 320, a not-shown sensor detects the polarity of the electrode terminal of the IC coin 204 contacting the electrode terminal 267 and the polarity of the electrode terminal of the IC coin 204 contacting the electrode terminal 268. Then, the power supply 272 supplies voltage, which has the same polarity as that of the electrode terminal of the IC coin 204 contacting the electrode terminal 267, to the electrode terminal 267 by switching the internal circuit in accordance with the detected result. Also, the power supply 272 supplies voltage, which has the same polarity as that of the electrode terminal of the IC coin 204 contacting the electrode terminal 268, to the electrode terminal 268 by switching the internal circuit in accordance with the detected result.

Thus, the electrode terminal 267 supplies anode voltage to the anode terminal 246 when the anode terminal 246 of the IC coin 204 contacts the electrode terminal 267, and the electrode terminal 267 supplies cathode voltage to the cathode terminal 247 when the cathode terminal 247 of the IC coin 204 contacts the electrode terminal 267. On the other hand, the electrode terminal 268 supplies anode voltage to the anode terminal 246 when the anode terminal 246 of the IC coin 204 contacts the electrode terminal 268, and the electrode terminal 268 supplies cathode voltage to the cathode terminal 247 when the cathode terminal 247 of the IC coin 204 contacts the electrode terminal 268.

Figure 24:
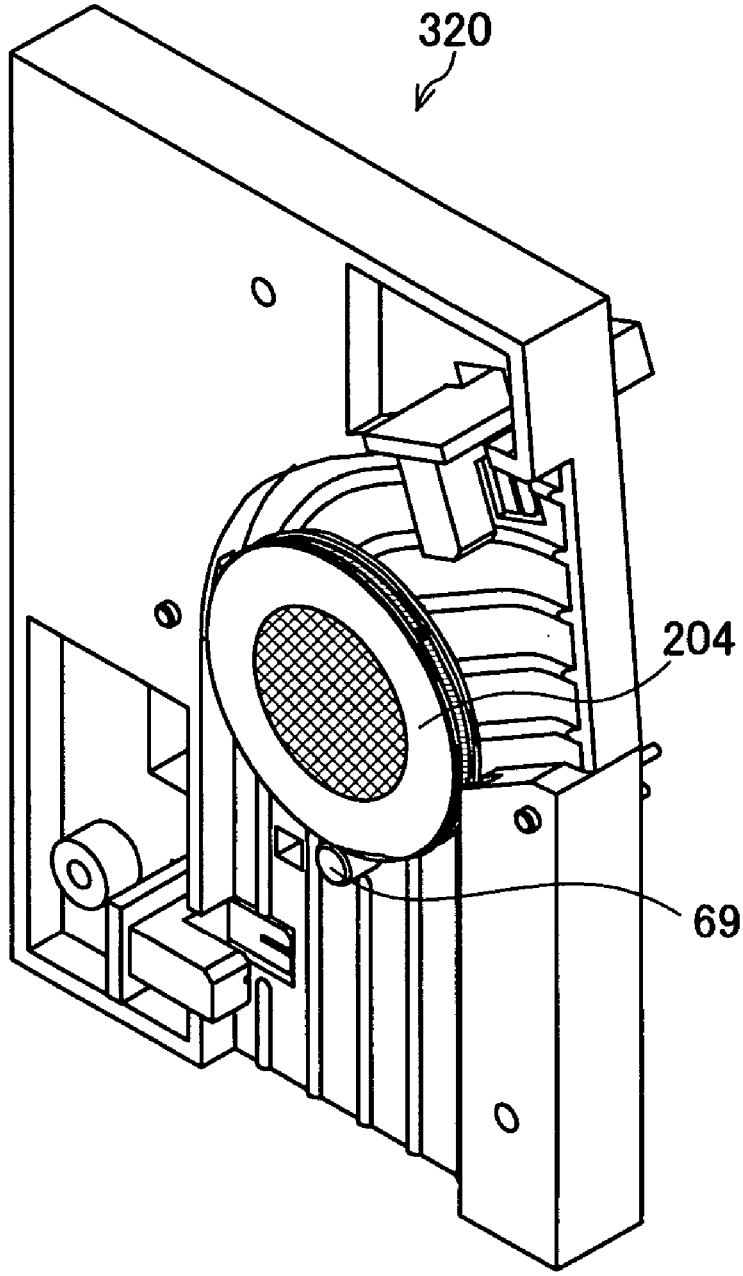
FIG. 24 is a perspective view of the recording medium processing device shown in FIGS. 23A and 23B, illustrating an inside structure of the recording medium processing device in which the IC coin is retained at the HP.

In the recording medium processing device 320 having the above structure, the IC coin 204 retained at the HP is supported by the stopper 69 and simultaneously the side of the IC coin 204 is sandwiched between the electrode terminals 267 and 268 opposed to each other as illustrated in FIG. 24.

The anode terminal 246 is formed on one half of the side periphery of the IC coin 204 and the cathode terminal 247 is formed on the other half of the side periphery of the IC coin 204. The electrode terminals 267 and 268 each contact the side of the IC coin 204 with the diameter of the IC coin 204 at the HP interposed between the electrode terminals 267 and 268. Thus, the anode terminal 246 contacts either one of the electrode terminals 267 and 268, and the cathode terminal 247 contacts the other one of the electrode terminals 267 and 268 regardless of the orientation of the IC coin 204 retained at the HP.

It is intended that the invention is not limited to the particular embodiments described herein, but that various modifications may be made without departing from the scope of the appended claims. In addition, all embodiments appropriately combining respective technical units disclosed in the above-described embodiments are included in the technical scope of the invention.

As described above, a coin-shaped recording medium according to the invention which contains: a transmitting and receiving portion transmitting and receiving value data showing a value degree to and from a recording medium processing device; and a recording circuit recording and holding the value data, is characterized by including: an image display portion to or from which an image can be written or deleted by applying voltage thereto; and a voltage input portion exposed on an external surface of the coin-shaped recording medium to input voltage applied to the image display portion by connecting with an external terminal.

The coin-shaped recording medium having the above structure which transmits and receives value data to and from the recording medium processing device and records the value data includes the voltage input portion exposed on the coin-shaped recording medium to input voltage by connecting with the external terminal. Thus, in the structure of the coin-shaped recording medium including the image display portion to or from which an image is written or deleted by applying voltage, voltage for writing or deleting an image can be inputted from outside to the coin-shaped recording medium, and an image can be written or deleted to or from the coin-shaped recording medium.

The coin-shaped recording medium having the above structure according to the invention is further characterized in that an image displayed on the image display portion is written or deleted by an image writing portion provided on the recording medium processing device.

In this case, the image writing portion writing or deleting an image displayed on the image display portion is provided on the recording medium processing device. Thus, in the coin-shaped recording medium which transmits and receives value data to and from the recording medium processing device, the recording medium processing device can write or delete an image to and from the image display portion.

The coin-shaped recording medium having the above structure according to the invention is further characterized in that the voltage input portion includes: first type electrodes exposed on the front face and back face of the coin-shaped recording medium to input first type voltage; and a second type electrode exposed on the side of the coin-shaped recording medium to input second type voltage.

In this case, the first type electrodes are exposed on the front face and back face of the coin-shaped recording medium, while the second type electrode is exposed on the side of the coin-shaped recording medium. Thus, by disposing a terminal for applying the first type voltage in such a position as to contact the front face or the back face of the coin-shaped recording medium and another terminal for applying the second voltage in such a position as to contact the side of the coin-shaped recording medium which is located at the predetermined position at the time of writing an image, for example, the first type voltage and the second type voltage can be inputted to the coin-shaped recording medium even when the front or back face of the coin-shaped recording medium is reversed to the opposite face at the predetermined position.

The first type voltage and the second type voltage refer to anode voltage and cathode voltage, respectively. When the first type voltage is anode voltage, the second type voltage is cathode voltage. Conversely, when the first type voltage is cathode voltage, the second type voltage is anode voltage.

The coin-shaped recording medium having the above structure according to the invention is further characterized in that the voltage input portion includes: a first type electrode exposed on the front face of the coin-shaped recording medium to input first type voltage; and a second type electrode exposed on the back face of the coin-shaped recording medium to input second type voltage.

In this case, the first type electrode is exposed on the front face of the coin-shaped recording medium, while the second type electrode is exposed on the back face of the coin-shaped recording medium. Thus, by disposing a terminal for applying the first type voltage in such a position as to contact the front face of the coin-shaped recording medium and another terminal for applying the second type voltage in such a position as to contact the back face of the coin-shaped recording medium which is located at the predetermined position at the time of writing an image, for example, the first type voltage and the second type voltage can be inputted to the coin-shaped recording medium.

The coin-shaped recording medium having the above structure according to the invention is further characterized in that the voltage input portion includes: a first type electrode exposed on one half of the side periphery of the coin-shaped recording medium to input first type voltage; and a second type electrode exposed on the other half of the side periphery of the coin-shaped recording medium to input second type voltage.

In this case, the first type electrode is exposed on one half of the side periphery of the coin-shaped recording medium, while the second type electrode is exposed on the other half of the side periphery of the coin-shaped recording medium. Thus, by disposing a terminal for applying the first type voltage in such a position as to be opposed to another terminal for applying the second voltage with the diameter of the coin-shaped recording medium, which is located at the predetermined position at the time of writing an image, interposed between those terminals, for example, the first type voltage and the second type voltage can be inputted to the coin-shaped recording medium.

The coin-shaped recording medium having the above structure according to the invention is further characterized in that: the image display portion is a first image display medium provided within the coin-shaped recording medium; and a transparent component is provided on a portion of a face of the coin-shaped recording medium which the first image display medium faces.

In this case, the first image display medium is provided within the coin-shaped recording medium, and the transparent component is provided on the portion of a face of the coin-shaped recording medium which the first image display medium faces. Thus, the coin-shaped recording medium provides one-face display by which an image formed on the front face or back face of the coin-shaped recording medium can be viewed from outside.

The coin-shaped recording medium having the above structure according to the invention is further characterized in that: the image display portion includes a first image display medium and a second image display medium provided within the coin-shaped recording medium; the first image display medium is opposed to a transparent component provided on the front face of the coin-shaped recording medium; and the second image display medium is opposed to a transparent component provided on the back face of the coin-shaped recording medium.

In this case, the first image display medium provided within the coin-shaped recording medium is opposed to the transparent component provided on the front face of the coin-shaped recording medium, and the second image display medium provided within the coin-shaped recording medium is opposed to the transparent component provided on the back face of the coin-shaped recording medium. Thus, the coin-shaped recording medium provides both-face display by which images formed on the front face and back face of the coin-shaped recording medium can be viewed from outside.

The coin-shaped recording medium having the above structure according to the invention is further characterized in that the voltage input portion is made of a stainless alloy.

In this case, corrosion of the voltage input portion which is exposed on the coin-shaped recording medium is prevented since the voltage input portion is made of a stainless alloy.

The coin-shaped recording medium having the above structure according to the invention is further characterized in that the transparent component is made of PET (polyethylene terephthalate).

In this case, the transparent component is made of PET, and thus the first image display medium and the second image display medium are covered with PET. As a result, those display media can be visually checked and protected from outside.

The coin-shaped recording medium having the above structure according to the invention is further characterized in that an image is written or deleted by the image writing portion to or from the image display portion based on value data transmitted to the coin-shaped recording medium.

In this case, since an image is written or deleted by the image writing portion to or from the image display portion based on the value data transmitted to the coin-shaped recording medium, the content of the value data recorded on the coin-shaped recording medium coincides with the content displayed by the image display portion. Thus, a user knows the value of the coin-shaped recording medium only by visually checking an image displayed on the coin-shaped recording medium.

As described above, a recording medium processing device according to the invention is characterized by including: a locating portion locating the above coin-shaped recording medium in a predetermined position; an image writing portion writing an image to the image display portion; and a voltage applying portion applying voltage to the voltage input portion of the coin-shaped recording medium located in the predetermined position by connecting with the voltage input portion.

The recording medium processing device having the above structure includes the voltage applying portion applying voltage to the voltage input portion of the coin-shaped recording medium located in the predetermined position by connecting with the voltage input portion. Thus, the recording medium processing device can apply voltage to the image display portion of the coin-shaped recording medium located in the predetermined position and thereby write an image to the image display portion.

The recording medium processing device having the above structure is further characterized in that the image writing portion is disposed in such positions as to be opposed to the front face of the coin-shaped recording medium and the back face of the coin-shaped recording medium located in the predetermined position.

In this case, the image writing portion is disposed in such positions as to be opposed to the front face of the coin-shaped recording medium and the back face of the coin-shaped recording medium located in the predetermined position. Thus, an image can be written to the coin-shaped recording medium either when the image display portion is positioned on the front face of the coin-shaped recording medium or when the image display portion is positioned on the back face of the coin-shaped recording medium.

The invention pertains to a coin-shaped recording medium used for a play machine or the like, and to a recording medium processing device for transmitting and receiving information to and from the recording medium. The invention is applicable to a play machine such as a pinball machine and a slot machine and to a game machine in a game center.

What is claimed is:

1. A coin-shaped recording medium, comprising:

a transmitting and receiving portion transmitting and receiving value data showing a value degree to and from a recording medium processing device;

a recording circuit recording and holding the value data;

an image display portion to or from which an image can be written or deleted by applying voltage and directing light thereto, the image being maintained without power supply after being written;

a voltage input portion exposed on an external surface of the coin-shaped recording medium to input voltage applied directly to the image display portion by connecting with an external terminal; and an integrated circuit device that records by wireless, separately from the image written or deleted to or from the image display portion, the received or transmitted value data from the transmitting and receiving portion, so that the data on the integrated circuit device coincides with the image on the image display portion;

wherein the voltage input portion includes:

a first type of electrode exposed on one half of the side periphery between the front and back faces of the coin-shaped recording medium to input first type voltage; and a second type electrode exposed on the other half of the side periphery between the front and back faces of the coin-shaped recording medium to input second type voltage.

2. A coin-shaped recording medium as set forth in claim 1, wherein an image displayed on the image display portion is written or deleted by an image writing portion provided on the recording medium processing device.

3. A coin-shaped recording medium as set forth in claim 1, wherein:

the image display portion is a first image display medium provided within the coin-shaped recording medium; and a transparent component is provided on a portion of a face of the coin-shaped recording medium which the first image display medium faces.

4. A coin-shaped recording medium as set forth in claim 1, wherein:

the image display portion includes a first image display medium and a second image display medium provided within the coin-shaped recording medium;

the first image display medium is opposed to a transparent component provided on the front face of the coin-shaped recording medium; and the second image display medium is opposed to a transparent component provided on the back face of the coin-shaped recording medium.

5. A coin-shaped recording medium as set forth in claim 1, wherein the voltage input portion is made of a stainless alloy.

6. A coin-shaped recording medium as set forth in claim 3, wherein the transparent component is made of PET (polyethylene terephthalate).

7. A coin-shaped recording medium as set forth in claim 4, wherein the transparent component is made of PET (polyethylene terephthalate).

8. A coin-shaped recording medium as set forth in claim 2, wherein an image is written or deleted by the image writing portion to or from the image display portion based on value data transmitted to the coin-shaped recording medium.

9. A recording medium processing device, comprising:

a locating portion locating a coin-shaped recording medium in a predetermined position, the coin-shaped recording medium including:

a transmitting and receiving portion transmitting and receiving value data showing a value degree to and from a recording medium processing device;

a recording circuit recording and holding the value data;

an image display portion to or from which an image can be written or deleted by applying voltage and directing light thereto, the image being maintained without power supply after being written;

a voltage input portion exposed on an external surface of the coin-shaped recording medium to input voltage applied directly to the image display portion by connecting with an external terminal;

an integrated circuit device that records by wireless, separately from the image written or deleted to or from the image display portion, the received or transmitted value data from the transmitting and receiving portion, so that the data on the integrated circuit device coincides with the image on the image display portion;

wherein the voltage input portion includes:

a first type of electrode exposed on one half of the side periphery between the front and back faces of the coin-shaped recording medium to input first type voltage; and a second type electrode exposed on the other half of the side periphery between the front and back faces of the coin-shaped recording medium to input second type voltage, and an image writing portion writing an image directly to the image display portion, a voltage applying portion applying voltage to the voltage input portion of the coin-shaped recording medium located in the predetermined position by connecting with the voltage input portion.

10. A recording medium processing device as set forth in claim 9, wherein the image writing portion is disposed in such a position as to be opposed to the front face and the back face of the coin-shaped recording medium located in the predetermined position.

11. A recording medium processing device as set forth in claim 9, wherein the image writing portion writes an image to the image display portion by emitting light onto the image display portion.

* * * * *